US006002118A

United States Patent [19]

Kawano et al.

[11] Patent Number: 6,002,118

[45] Date of Patent: Dec. 14, 1999

[54] AUTOMATIC PLATE BENDING SYSTEM USING HIGH FREQUENCY INDUCTION HEATING

[75] Inventors: Takayuki Kawano; Yoshiaki Inoue; Ryuuichirou Kikutsugi; Kazuaki Oota; Fukumi Hamaya; Hidetsugu Koiwa; Shouji Kawakado; Takeshi Nakahama; Takijiro Shimamoto; Yasukazu Ide, all of Nagasaki, Japan

[73] Assignee: Mitsubishi Heavy Industries, Ltd., Tokyo, Japan

[21] Appl. No.: 09/159,761

[22] Filed: Sep. 24, 1998

[30] Foreign Application Priority Data

| | | | |
|---|---|---|---|
| Sep. 19, 1997 | [JP] | Japan | 9-263751 |
| Sep. 24, 1997 | [JP] | Japan | 9-258200 |
| Sep. 24, 1997 | [JP] | Japan | 9-258201 |
| Sep. 24, 1997 | [JP] | Japan | 9-258202 |
| Sep. 29, 1997 | [JP] | Japan | 9-263748 |
| Sep. 16, 1998 | [JP] | Japan | 10-261088 |
| Sep. 16, 1998 | [JP] | Japan | 10-261089 |

[51] Int. Cl.[6] ..... H05B 6/10

[52] U.S. Cl. ..... 219/602; 72/342.1

[58] Field of Search ..... 219/602, 603, 219/622; 72/342.1, 342.5, 342.6, 342.94, 31.1, 31.11

[56] References Cited

U.S. PATENT DOCUMENTS

| | | | |
|---|---|---|---|
| 3,831,425 | 8/1974 | Kita | 219/602 |
| 3,845,650 | 11/1974 | Romanov et al. | 72/342.1 |
| 4,569,218 | 2/1986 | Baker et al. | 72/342 |
| 4,803,864 | 2/1989 | Brysbaert et al. | 72/202 |
| 5,313,815 | 5/1994 | Nichting et al. | 72/364 |
| 5,753,894 | 5/1998 | Isoyama et al. | 219/602 |
| 5,802,905 | 9/1998 | Biswas et al. | 72/270 |

FOREIGN PATENT DOCUMENTS

| | | |
|---|---|---|
| 600541 | 1/1994 | Japan . |
| 6226360 | 8/1994 | Japan . |
| 724534 | 1/1995 | Japan . |
| 760368 | 3/1995 | Japan . |
| 775835 | 3/1995 | Japan . |

*Primary Examiner*—Teresa Walberg
*Assistant Examiner*—Jeffrey Pwu

[57] ABSTRACT

An automatic plate bending system using high frequency induction heating has many universal poles for bearing a steel plate, a member to be heated, by supporting it from below, the height positions of front end portions of the universal poles themselves being adjustable, and automatically moves a high frequency heating coil of a high frequency heating head above the steel plate, which is placed on the universal poles, along predetermined heating lines while retaining a constant clearance between the high frequency heating coil and the surface of the steel plate, whereby the steel plate is heated and automatically bent into a desired shape.

46 Claims, 29 Drawing Sheets

Before heating

After heating

AUTOMATIC PLATE BENDING SYSTEM USING HIGH FREQUENCY INDUCTION HEATING

BACKGROUND OF THE INVENTION

1. Field of the Invention

This invention relates to an automatic plate bending system using high frequency induction heating, and more specifically, to one useful for application to the bending of a steel plate having complicated curved surfaces, such as an outer panel of a ship hull.

2. Description of the Prior Art

The outer panel of a ship hull is composed of a steel plate about 10 to 30 mm thick with a complicated undevelopable curved surface which reduces propulsion resistance for efficient navigation in the water. To form this curved outer panel, a processing method generally called line heating has been known for long. This method heats the surface of a steel plate locally by means of a gas burner or the like, to cause the extraplane angular deformation or intraplane shrinkage deformation of the steel plate due to plastic distortion, and skillfully combines these deformations to obtain the desired shape. This method is used at many shipyards.

FIG. 1 is an explanation drawing conceptually showing an earlier technology concerned with a method for bending a steel plate to serve as an outer panel of a ship hull. FIG. 2 is a front view showing a wooden pattern for use in the bending in a state in which it is mounted on the steel plate. As shown in both drawings, according to the earlier technology, many (10 in the drawing) wooden patterns 1 following frame lines of the outer panel of the ship hull (lines extending along frame materials for the outer panel at positions where the frame materials are attached; the same will hold in the following description) as target shapes are mounted on a steel plate 2. Then, an operator compares the shapes of each wooden pattern 1 and the steel plate 2 by visual observation, and considers differences between their shapes, e.g., the clearance between the wooden pattern 1 and the steel plate 2. Based on this consideration, the operator studies what position to heat in order to bring the steel plate 2 close to the target shape. As a result, the operator determines each heating position (heating point). Concretely, the wooden pattern 1 is rolled along the frame line of the steel plate 2 in a vertical plane (the same plane as in FIG. 2). The points of contact of the wooden pattern 1 with the steel plate 2 during the rolling motion are watched to determine the heating points in consideration of the clearance between the wooden pattern 1 and the steel plate 2 in each state.

Then, it is considered how to connect the respective heating points together in order to make the steel plate 2 similar to the target shape. Based on this consideration, a heating line is determined. As shown in FIG. 3, heating lines 3 that have been determined are marked on the surface of the steel plate 2 with chalk or the like, and the steel plate 2 is heated with a gas burner along the heating lines 3.

With the earlier technology as described above, the steel plate 2 is heated with a gas burner by the operator along the heating lines 3 determined by the operator's sense based on many years of experience. As a result, a predetermined curved surface is obtained. Acquiring the ability to determine the heating lines 3 rationally is said to require more than about 5 years of experience. This has posed the problems of the aging and shortage of experienced technicians. The bending procedure also takes a large amount of time for incidental operations, such as the production, mounting and removal of the wooden pattern 1 for the steel plate 2, thus lengthening the entire operating time. Besides, the heating operation using a gas burner itself becomes heavily muscular activity in a hot, humid harsh environment involving the occurrence of steam associated with the evaporation of cooling water. Hence, a demand is growing for the advent of a device which realizes the automation of the plate bending operation.

To solve the problem of the shortage of experienced technicians and reduce the operating time, it is necessary to improve, theorize and automate the bending operation while taking into consideration know-how that operators acquired through experience.

Generally, bending of a plate material such as a steel plate is performed using a press or the like. To process the plate material into a complicated shape which is hard to form with a press, hot bending by a gas burner is used. The operation using a gas burner causes the problem of a deteriorated work environment due to noise, heat and combustion gases. Recently, therefore, high frequency induction heating has been studied. High frequency induction heating produces eddy currents in a member to be heated, e.g., a steel plate, by the action of electromagnetic induction, and applies heat by utilizing an eddy-current loss. Thus, a high frequency heating coil is required for high frequency induction heating.

FIG. 4 shows an example of a high frequency induction heater for heating a flat plate-shaped member to be heated, such as a steel plate 1, from above. A high frequency heating coil 02 is provided opposite the steel plate 1 via a clearance $\Delta t$ so as to be movable by a moving device 04 in the direction of an arrow A. The clearance $\Delta t$ is about 5 mm. The high frequency heating coil 02 is secured to a lower end of a bar-shaped support arm 05 via a disk portion 03, and the support arm 05 is supported by a guide portion 04*a* of the moving device 04 so as to be movable vertically. Thus, the high frequency heating coil 02 moves linearly in a vertical direction integrally with the support arm 05. The moving device 04 has its moving speed controlled by a moving speed controller 06, and moves horizontally linearly along a guide rail 07. In the drawing, the reference numeral 08 denotes a matching transformer, and the numeral 09 designates a high frequency power source. To achieve desired uniform heating with such a high frequency induction heater, it is vital to keep the clearance $\Delta t$ between the high frequency heating coil 02 and the steel plate 1 constant. This is because a heat input to the steel plate 1 is determined simply by the clearance $\Delta t$ as a parameter along with an electric current supplied to the high frequency heating coil 02, its frequency, and the moving speed of the high frequency heating coil 02.

High frequency induction heating thus requires that the clearance $\Delta t$ between the high frequency heating coil 02 and the steel plate 1 be kept constant. To meet this requirement, the high frequency induction heater according to the earlier technology has a laser sensor provided near the high frequency heating coil 02, measures the distance between the high frequency heating coil 02 and the steel plate 1 by the laser sensor, and extends or contracts the support arm 05 to keep the clearance $\Delta t$ between the high frequency heating coil 02 and the steel plate 1 constant. However, the laser sensor is vulnerable to high temperatures or steam. Thus, it is difficult to protect the laser sensor, for example, from radiant heat generated when the temperature of the steel plate 1 rises to 800° C., or from steam produced when the heated steel plate 1 is cooled with water. There is also the problem that laser light is disturbed by steam, and measurement errors will result.

Hot bending of the steel plate involves various forms of heating, including line heating for heating in a linear form, spot heating for heating predetermined spots in a circular form, weaving heating for heating in a zigzag form, and pine needle heating for heating in a triangular form.

To accommodate various forms of heating mentioned above, various coils adapted to the forms of heating are made ready for use, and a coil may be changed to agree with the form of heating. That is, an attachment type coil may be used. For such an attachment type, however, many coils in agreement with the forms of heating must be prepared, and coil replacement is required each time the form of heating is changed. This presents with the problems of boosted equipment cost and decreased operating efficiency.

SUMMARY OF THE INVENTION

The present invention is to solve the above-described problems with the earlier technologies. A first object of this invention is to provide an automatic plate bending system using high frequency induction heating which can bend a steel plate having a complicated curved surface, such as an outer panel of a ship hull, into a target shape automatically.

A second object of the invention is to provide a method and a system for determining heating points and heating lines in steel plate bending, the method and system being capable of determining heating points and heating lines without using a wooden pattern, and being capable of assisting in the automatic determination of heating points and heating lines.

A third object of the invention is to provide a mounting clearance retaining system for a high frequency heating coil, the system being capable of satisfactorily keeping clearance between the high frequency heating coil and a member to be heated constant, without undergoing adverse influence of radiant heat and steam from the member to be heated.

A fourth object of the invention is to provide a high frequency heating coil device capable of various forms of heating with a single type of coil.

The present invention that attains the foregoing objects is characterized by the following aspects:

1) The system of the invention comprises:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heation coil for induction heating the surface of a member to be heated, the high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system.

According to this aspect, plate bending can be performed automatically without using a wooden pattern or the like or without relying on work by an operator. Thus, the efficiency of a bending operation can be remarkably raised, and much experience is not required for the operation.

2) The system of the invention comprises:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, the high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system.

According to this aspect, the shape of the member to be heated can be measured automatically using the travel system of the automatic plate bending system, in addition to the effect of the invention described in connection with the aspect 1).

3) The clearance between the high frequency heating coil and the surface of the member to be heated is secured by providing steel balls around the high frequency heating coil, and bringing the steel balls into contact with the surface of the member to be heated.

4) The clearance between the high frequency heating coil and the surface of the member to be heated is secured by providing a magnet around the high frequency heating coil, and causing a magnetic force to work between the magnet and the member to be heated.

5) The clearance between the high frequency heating coil and the surface of the member to be heated is secured by providing a high pressure gas jetting unit near the high frequency heating coil, and directing a high pressure gas jetted by the high pressure gas jetting unit toward the surface of the member to be heated, thereby generating a reaction force.

According to the aspects described in 3) to 5), the clearance between the high frequency heating coil and the member to be heated can be kept constant by the contact of the steel balls with the member to be heated, by the action of a magnetic force, or by the action of a reaction force generated by jets of a high pressure gas.

6) The high frequency heating coil has a circular shape whose diameter nearly equals the diameter of a flame of a gas burner to be used when heating the same member to be heated.

According to this aspect, various forms of heating can be performed by the use of one type of high frequency heating coil.

7) The system of the invention comprises:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, the high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

According to this aspect, the excessive bending of the member to be heated can be prevented, in addition to the effects of the invention described in connection with the aspects 1) and 2).

8) The system of the invention further comprises:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate, such as a frame line, from a predetermined reference position in a plane including a cross section of the steel plate, to bring the wooden pattern and the steel plate into contact at two points, with the contact points on the steel plate being designated as A, B, and the contact points on the wooden pattern being designated as C, D;

then rolls the wooden pattern or the steel plate in the reverse direction to return it to the reference position;

with the wooden pattern or the steel plate being returned to the reference position, obtains a straight line U connecting the contact points A, B and a straight line V connecting the contact points C, E;

calculates the three-dimensional coordinates of a heating point on the basis of a point of intersection of the straight lines U, V;

based on an angle of intersection of the straight lines U, V, calculates a bending angle for the steel plate at the heating point; and after obtaining a heating point, or a heating point and a bending angle, relative to a certain reference point, repeats the same steps as described above while bringing the contact points A, C on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points calculated by the heating point determining unit;

draws straight lines from a certain heating point on a certain line, as a starting point, to heating points on other lines on the basis of data on the respective heating points;

examines the degree of parallelism between each of the straight lines and a roller line involved during primary bending of the steel plate;

if the degree of parallelism is within a predetermined range, performs grouping of the relevant heating points as the heating points of the same group; and connects the respective heating points of the same group by a straight line or a curve to determine a heating line; or a heating line determining unit which reads in data on the heating points and bending angles calculated by the heating point determining unit;

draws straight lines from a certain heating point on a certain line, as a starting point, to heating points on other lines on the basis of data on the respective heating points;

examines the degree of parallelism between each of the straight lines and a roller line involved during primary bending of the steel plate;

if this degree of parallelism is within a predetermined range, performs grouping of the relevant heating points as the heating points of the same group;

connects the respective heating points of the same group by a straight line or a curve to determine a heating line; and calculates the amounts of heating at the respective heating points on the basis of the data on the bending angles of the steel plate at the respective heating points; or a heating line determining unit which reads in data on the heating points and bending angles calculated by the heating point determining unit;

draws straight lines from a certain heating point on a certain line, as a starting point, to heating points on other lines on the basis of data on the respective heating points and bending angles;

examines the degree of parallelism between each of the straight lines and a roller line involved during primary bending of the steel plate;

if this degree of parallelism is within a predetermined range, and if the amounts of heating at the heating points determined by the bending angles of the steel plate at the respective heating points are equal to each other, performs grouping of the relevant heating points as the heating points of the same group; and connects the respective heating points of the same group by a straight line or a curve to determine a heating line.

According to this aspect, all the heating points, or heating points and bending angles, on a specific line of the steel plate can be determined automatically. Furthermore, heating lines and bending angles (amounts of heating) can be determined simultaneously. Besides, appropriate heating lines can be prepared automatically on the basis of information on the heating points. Consequently, automatic bending of a predetermined steel plate can be carried out by controlling the position of the heating unit of the high frequency heater on the basis of data on the heating lines.

FIGS. 5(*a*) and 5(*b*) show, by contcur lines, the shapes of a steel plate before and after its heating along heating lines determined by the present invention. FIG. 5(*a*) represents the contour lines before heating, indicating the difference between the shape of the steel plate and the target shape as a difference in color. A blue portion at the center of the steel plate has a difference of 5 mm from the target shape, while a red portion at the end of the steel plate has a difference of 50 mm. These findings demonstrate that the farther from the center and the nearer the end, the greater a deviation from the target shape becomes. FIG. 5(*b*), on the other hand, represents the contour lines after heating the steel plate along the heating lines of the present invention. A look at this drawing will show that a blue portion widens, so that the shape approaches the target shape markedly. That is, sufficiently useful heating lines can be determined without the need to use a wooden pattern concerned with earlier technologies.

9) The system of the invention further comprises:

a heating point determining unit which reads in target shape data on a target shape of a steel plate to be bent, and steel plate shape measurement data to be obtained by measuring a surface shape of the steel plate;

divides a curve of the target shape of the steel plate into a plurality of successive segments;

similarly divides a curve of the measured shape of the steel plate into a plurality of successive segments in correspondence with the curve of the target shape;

determines the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape in each segment by the number of the isosceles triangles to form respective points on the arc; and calculates the coordinates of the respective points as heating points.

According to this aspect, the deviation of the surface shape of the steel plate, the object to be processed, from the target shape is grasped as a geometrical problem mediated by the angle between the base of each isosceles triangle and the base of the adjacent isosceles triangle of the multiplicity of specific isosceles triangles. Thus, all the heating point so a specific line of the steel plate can be determined automatically.

DETAILED DESCRIPTION OF THE PREFERRED EMBODIMENTS

Embodiments of the present invention will now be described in detail with reference to the accompanying drawings. However, it is to be understood that these embodiments are given only for illustrative purposes and do not restrict the invention.

Figure 6:
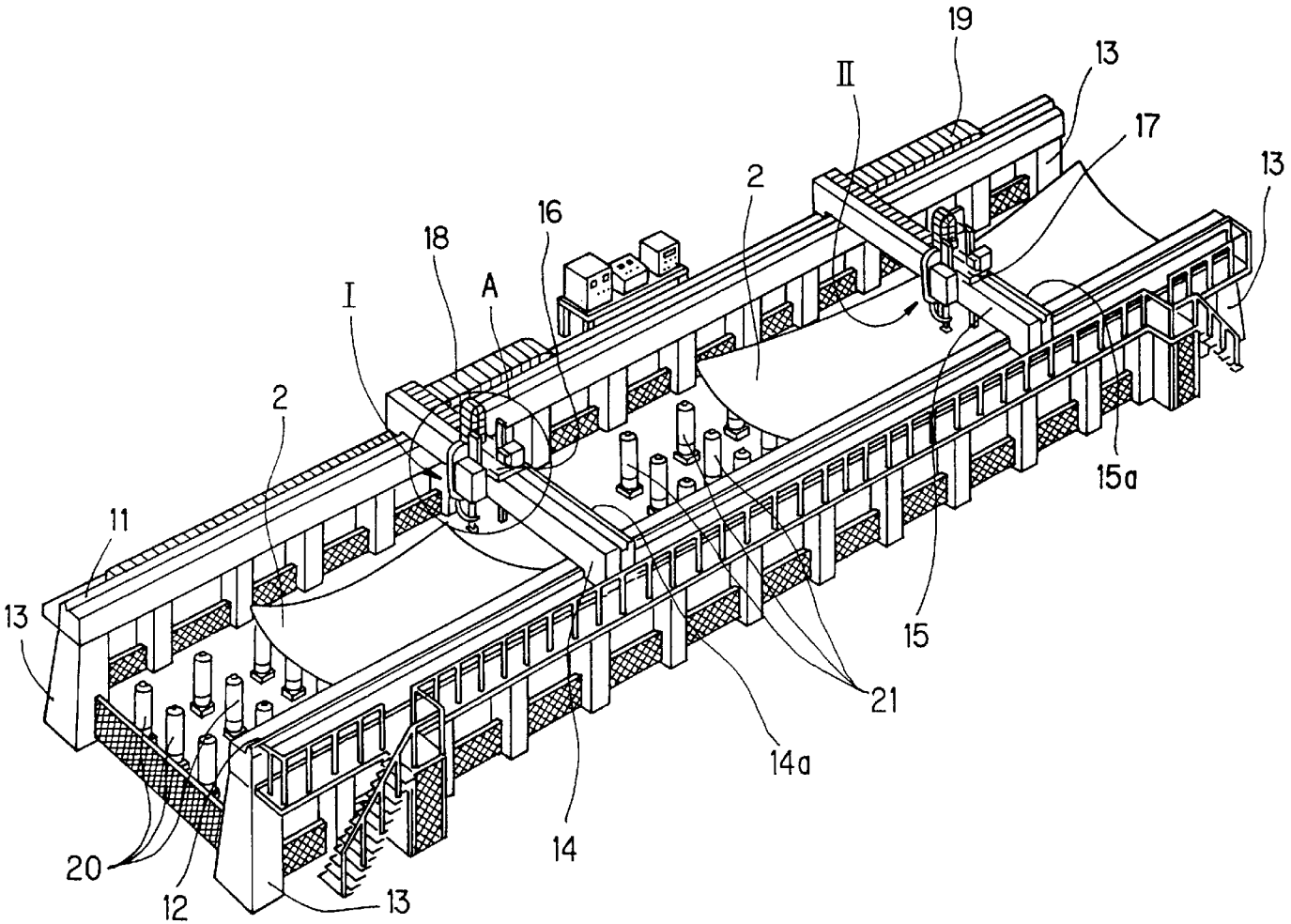
FIG. 6 is a perspective view showing the whole of an automatic plate bending system concerned with an embodiment of the present invention.

FIG. 6 is a perspective view showing the whole of an automatic plate bending system concerned with an embodiment of the present invention. As shown in FIG. 6, two parallel travel rails 11, 12 are mounted on many frame legs 13 erected on a floor surface, and longitudinally traveling trolleys 14, 15 stretching over the travel rails 11, 12 run along these travel rails 11, 12 (in the X axis direction). Transversely traveling trolleys 16, 17 bear high frequency heaters I, II and run on transverse travel rails 14*a*, 15*a* provided on the longitudinally traveling trolleys 14, 15 in a direction perpendicular to the moving direction of the longitudinally traveling trolleys 14, 15 (i.e., in the Y axis direction). These longitudinally traveling trolleys 14, 15 and transversely traveling trolleys 16, 17 constitute a travel system which runs freely in a horizontal plane (XY plane). Power supply belts 18, 19 feed an electric power, high pressure air, and cooling water to the high frequency heaters I, II, and are composed of a flexible material so as o be able to move in response to the movement of the longitudinally traveling trolleys 14, 15. Universal poles 20, 21 are erected vertically on the floor surface at a multiplicity of specified positions between the travel rails 11 and 12, with the positions of front end portions of the universal poles themselves being adjustable, so as to bear steel plates 2, members to be heated in the instant embodiment, by supporting the steel plates 2 from below. That is, the position of each universal pole 20 or 21 (X coordinate and Y coordinate) in a horizontal plane (XY plane) is preset to be a predetermined position, and the height position of the front end portion of each universal pole 20 or 21 (i.e., Z coordinate) is adjustable by a built-in drive source, such as a drive motor.

The system illustrated in FIG. 6 has two of the longitudinally traveling trolleys 14, 15 and two of the high frequency heaters I, II, and gives two working areas so that a bending operation can be performed simultaneously in each working area. However, the numbers of these trolleys, heaters and working areas can, needless to say, be set arbitrarily. Also, the constituent elements in the respective working areas, such as the longitudinally traveling trolleys 14, 15 and the high frequency heaters I, II, are constructed in exactly the same way. In the description to follow, therefore, the constitution concerned with the first working area, which comprises constituent elements, such as the longitudinally traveling trolley 14 and the high frequency heater I, will be explained.

Figure 1:
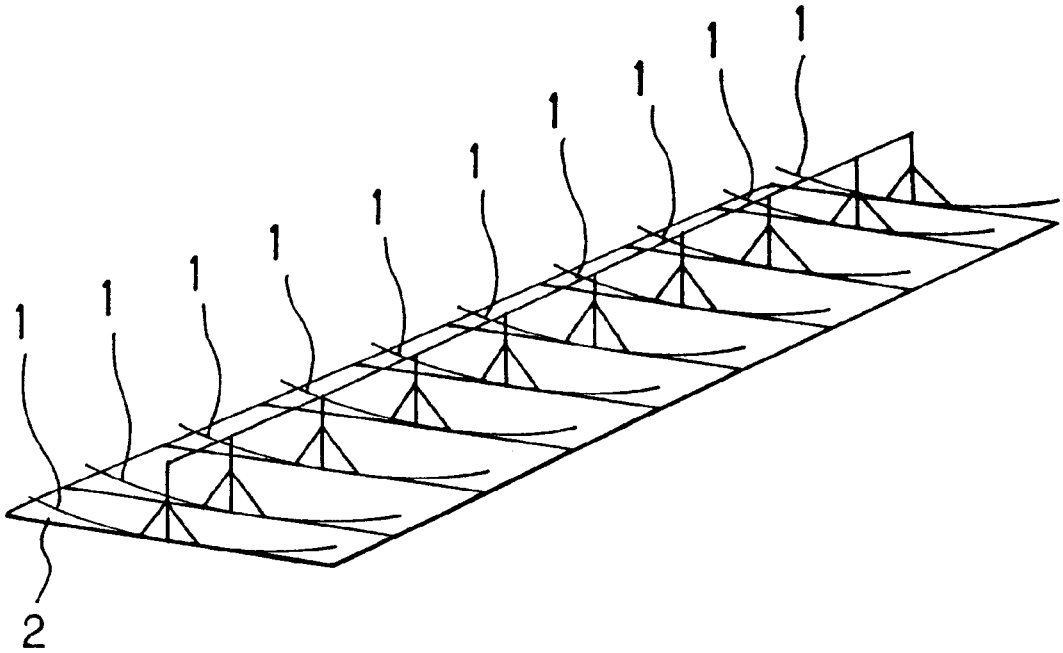
FIG. 1 PRIOR ART
FIG. 1 is an explanation drawing conceptually showing an earlier technology concerned with a method for bending a steel plate which will serve as an outer panel of a ship hull.
Figure 2:
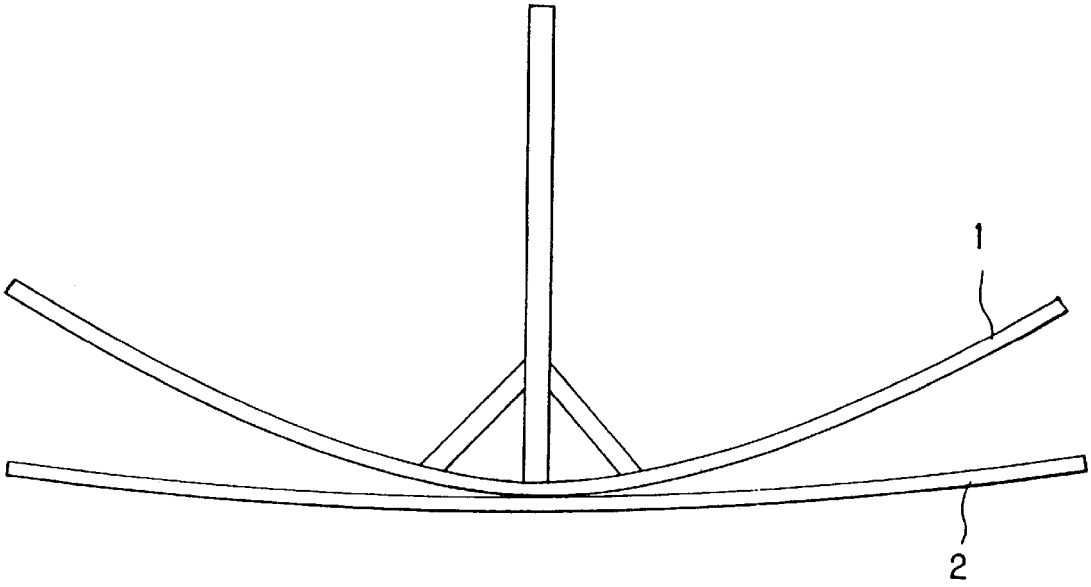
FIG. 2 PRIOR ART
FIG. 2 is a front view showing a wooden pattern for use in the bending of a steel plate according to the earlier technology, the wooden pattern being mounted on the steel plate.
Figure 7:
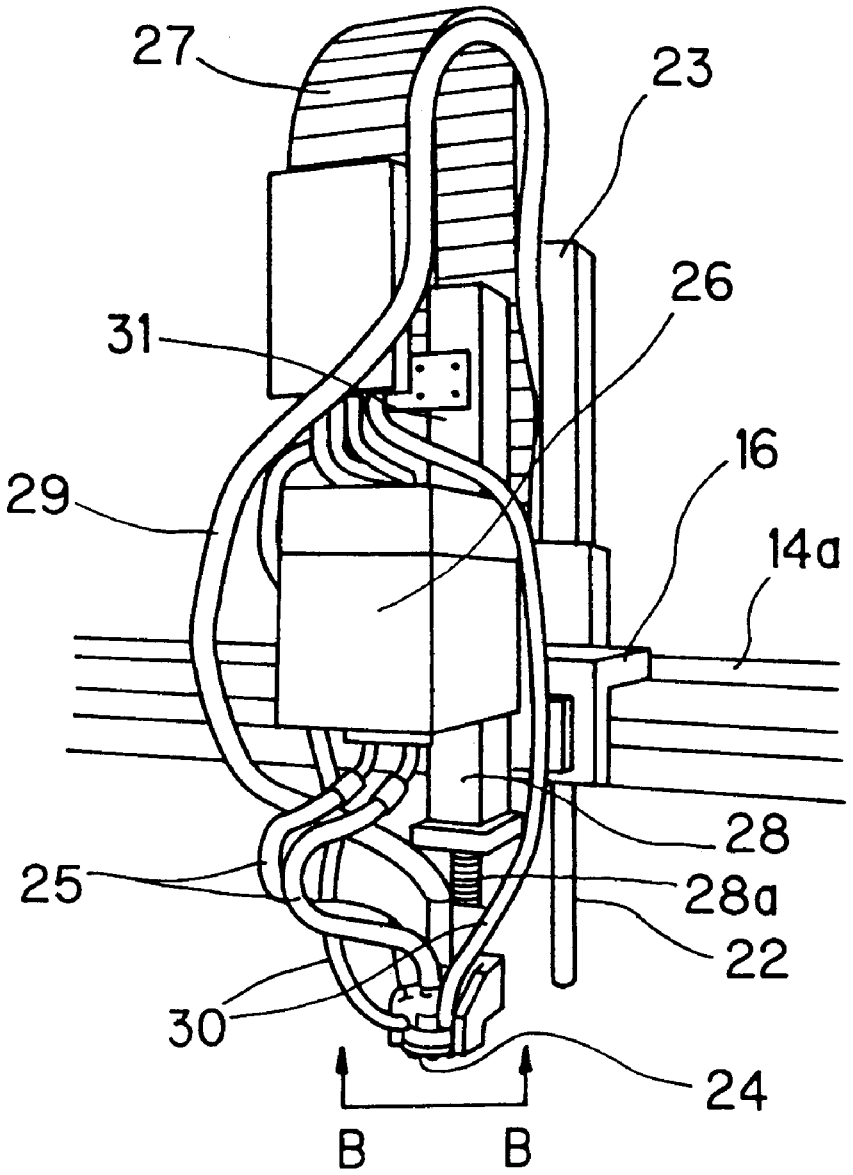
FIG. 7 is an enlarged perspective view showing a high frequency heater I, an A portion in FIG. 6, in an extracted and enlarged manner.

FIG. 7 is an enlarged perspective view showing the high frequency heater I, an A portion in FIG. 1, in an extracted and enlarged manner. As shown in FIG. 7, the transversely traveling trolley 16 running on the transverse travel rail 14*a* bears a shape measuring unit 22 as well as the high frequency heater I. The shape measuring unit 22 and the high frequency heater I move freely in a horizontal plane integrally with the transversely traveling trolley 16. The shape measuring unit 22 is movable vertically along a guide 23 secured to the transversely traveling trolley 16. The shape measuring unit 22 has a lower end portion in contact with the surface of the steel plate 2, traces the shape of this surface with the lower end portion, and detects displacements with a sensor such as a differential transformer, thereby supplying measurement data on the surface shape of the steel plate 2. The high frequency heater I has a high frequency heating head 24, high frequency flexible water cooled cables 25, a matching transformer 26, a power cable 27, an air cylinder 28, an air hose 29, and cooling water hoses 30. The high frequency heating head 24 is secured to a front end of a piston rod 28*a* of the air cylinder 28 so that a heating surface of its high frequency heating coil will be opposed to the surface of the steel plate 2. When driven by the air cylinder 28, the high frequency heating head 24 contacts or leaves the steel plate 2. The high frequency heating head 24 is also movable vertically, together with the air cylinder 28 and the matching transformer 26, along a travel rail 31 secured to the transversely traveling trolley 16.

The high frequency heating coil of the high frequency heating head 24 is supplied with an electric power via the power cable 27, matching transformer 26 and high frequency flexible water cooled cables 25, and also supplied with cooling water through the cooling water hoses 30. The air cylinder 28 is fed with high pressure air through the air hose 29. The power cable 27, cooling water hoses 30 and air hose 29 are connected to the power supply belt 18 (see FIG. 6).

Figure 8:
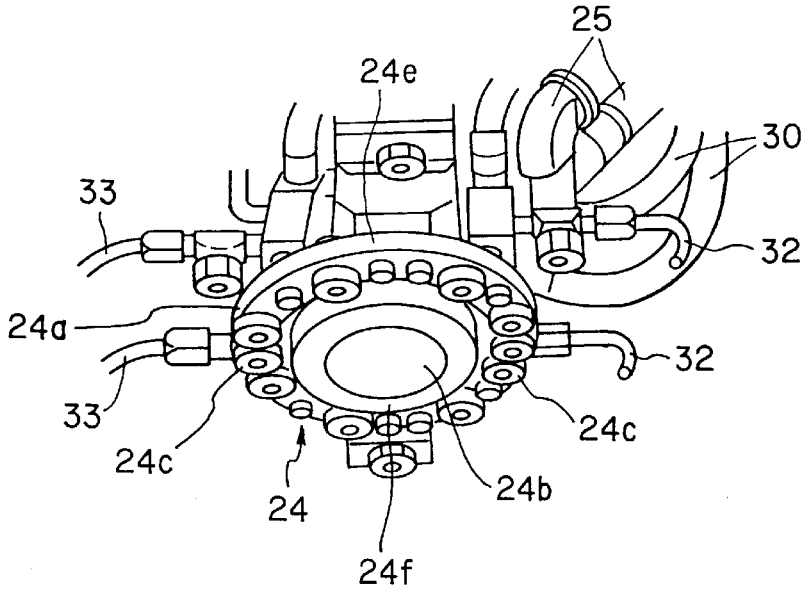
FIG. 8 is a perspective view showing a high frequency heating head concerned with the embodiment of the present invention as viewed from below.

FIG. 8 is a perspective view taken on line B—B of FIG. 7, showing the high frequency heating head 24 and its vicinity in an extracted manner. As shown in FIG. 8, the high frequency heating head 24 is secured to the piston rod 28*a* of the air cylinder 28 (see FIG. 7) via a disk portion 24*a*. The high frequency heating head 24 has acoil portion 24*b* secured to a central part of the disk portion 24*a*, and many steel ball portions 24*c* secured to the disk portion 24*a* along the outer periphery of the coil portion 24*b*. The steel ball portions 24*c* contact the surface of the steel plate 2 as a surface to be heated, thus smoothing the movement of the high frequency heating head 24 along the surface of the steel plate 2 in accordance with the movement of the high frequency heater I, and also function to retain a constant clearance between the coil portion 24*b* and the surface of the steel plate 2. The amount of heat input to the steel plate 2 during high frequency heating is determined solely by parameters consisting of an electric current supplied to the coil portion 24*b*, its frequency, the moving speed of the coil portion 24*b*, and the aforementioned clearance. To achieve the desired uniform heating, therefore, it is an essential requirement to keep this clearance constant. In FIG. 8, the numeral 32 denotes a nozzle, which supplies cooling water to a heating portion via the cooling water hoses 33 during heating with the coil portion 24*b*.

Figure 9:
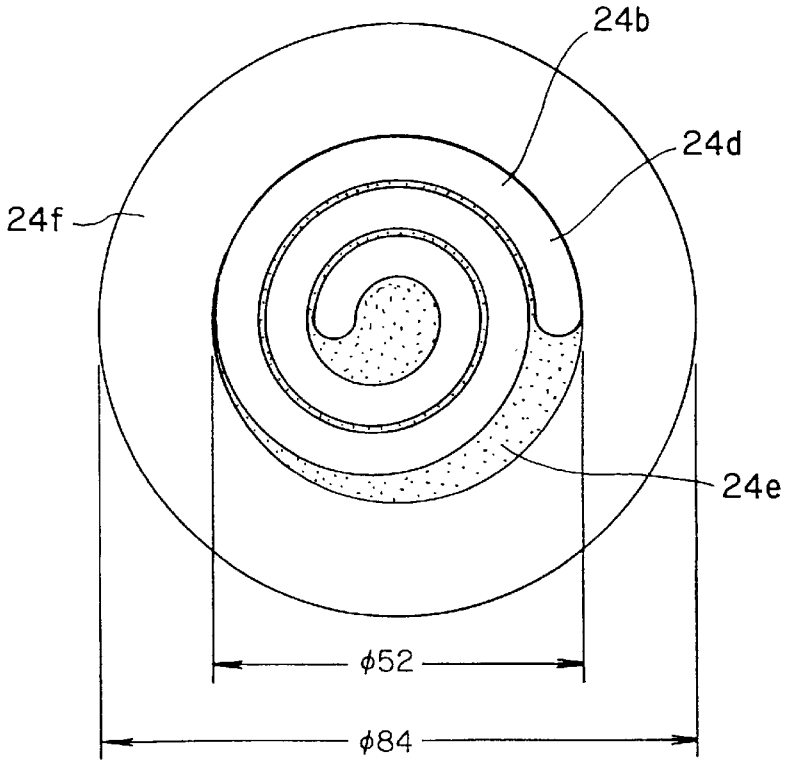
FIG. 9 is a plan view showing a coil portion of the high frequency heating head of FIG. 8 in an enlarged manner.

FIG. 9 is a plan view showing the coil portion 24*b* of the high frequency heating head 24 of FIG. 8 in an enlarged manner. As shown in FIG. 9, the coil portion 24*b* is a portion which generates a magnetic flux for induction heating the steel plate 2. In this embodiment, the coil portion 24*b* is composed, in a generally circular form, of a conductive portion 24*d* comprising a spirally molded copper plate, and an insulating material 24*e* for filling up the gap of the conductive portion 24*d*. Around the coil portion 24*b*, a core portion 24*f* is provided which is formed of a polyiron core to serve as a magnetic path. The circular shape of the coil portion 24*b* is one whose diameter nearly equals the diameter of a flame of a gas burner used when heating the steel plate 2, the same member to be heated. Thus, the coil portion 24*b* can achieve heating comparable to heating with the gas burner. As a preferred example, the coil portion 24*b* is 52 mm in diameter, while the core portion 24*f* is 84 mm in diameter.

Figure 10:
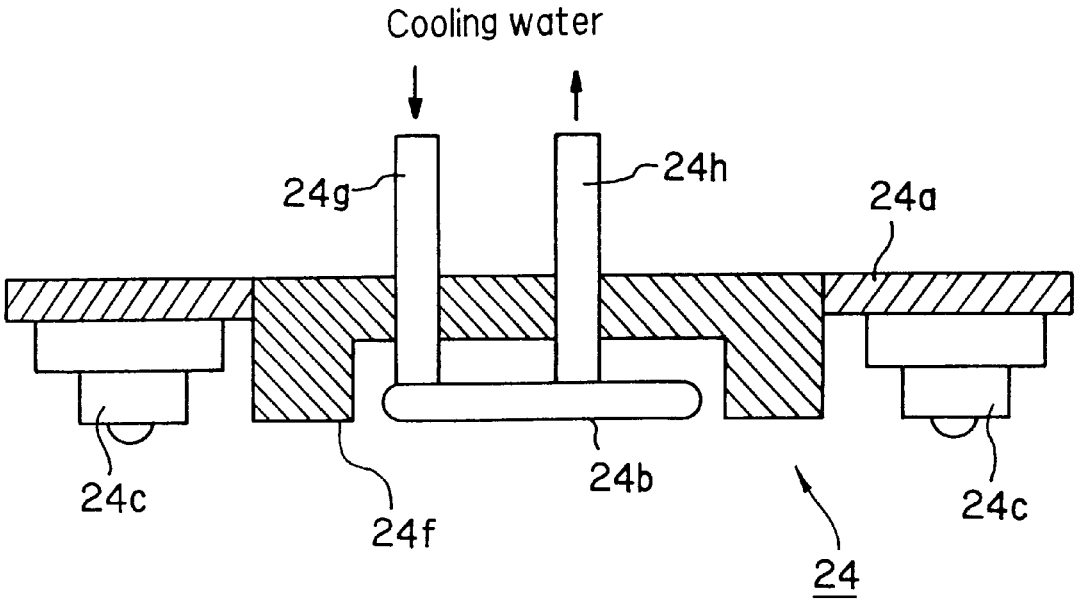
FIG. 10 is a vertical sectional view of the high frequency heating head of FIG. 8 in an enlarged manner.

FIG. 10 is a vertical sectional view showing the high frequency heating head 24 of FIG. 8 in an enlarged manner. As shown in FIG. 10, the core portion 24*f* is a disk-shaped member having a recess which the coil portion 24*b* faces. The core portion 24*f* serves as a magnetic path of a magnetic flux generated by the coil portion 24*b*. Pipes 24*g*, 24*h* vertically perforate through the core portion 24*f*, and cool the coil portion 24*b* with cooling water flowing through the pipes 24*g*, 24*h*. The disk portion 24*a* is a ring-shaped member, which has the core portion 24*f* fitted into its center for fixation.

In the foregoing embodiment, the insulating material 24*e* is cooled simultaneously with cooling of the coil portion 24*b* with cooling water, and thus can be formed from a heat resistant resin. The frequency of an electric current for induction heating is preferably, say, 20 kHz to 30 kHz. Since the member to be heated is a steel plate in the instant embodiment, the frequency may be suitably determined by the depth of penetration of the magnetic flux, heating efficiency, and so on, but may vary by several kilohertzes depending on the heating conditions. The range of the heating frequency is generally from several kHz to 60 kHz for a steel plate, but may favorably be 50 kHz to 100 kHz for an aluminum alloy. Of course, the optimum frequency varies with the thickness of the member to be heated. For a steel plate about 10 to 30 mm in thickness, the optimum diameter of the coil portion 24*b* is about 52 mm, which is the same dimension as the diameter of a flame of a gas burner for steel plate bending by conventional gas burner heating.

Figure 3:
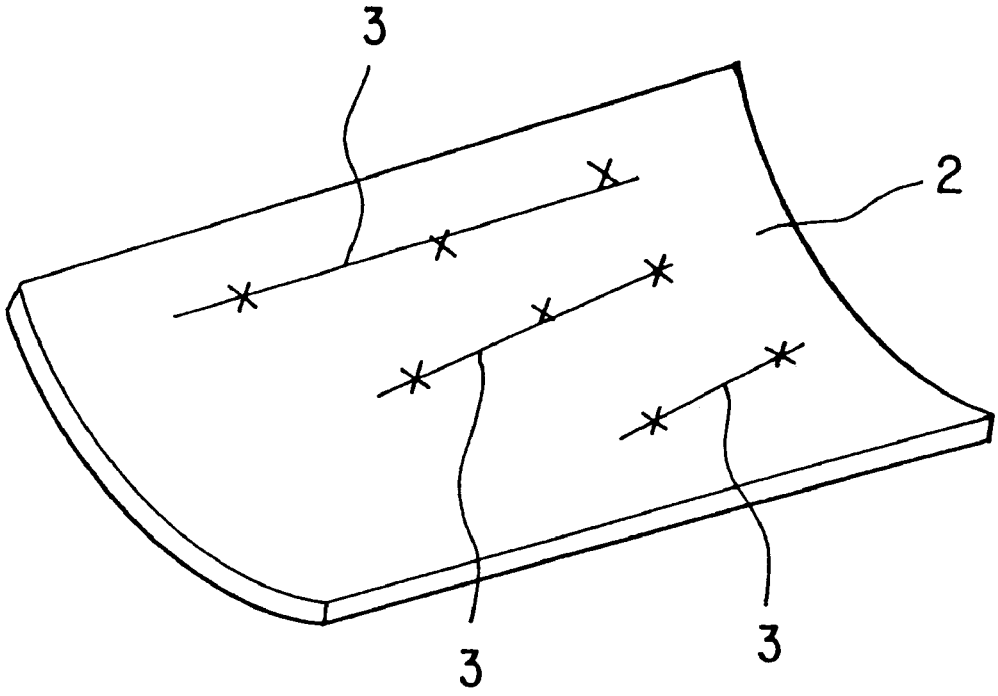
FIG. 3 PRIOR ART
FIG. 3 is a perspective view showing a state in which heating lines determined by the earlier technology are applied to a steel plate.
Figure 4:
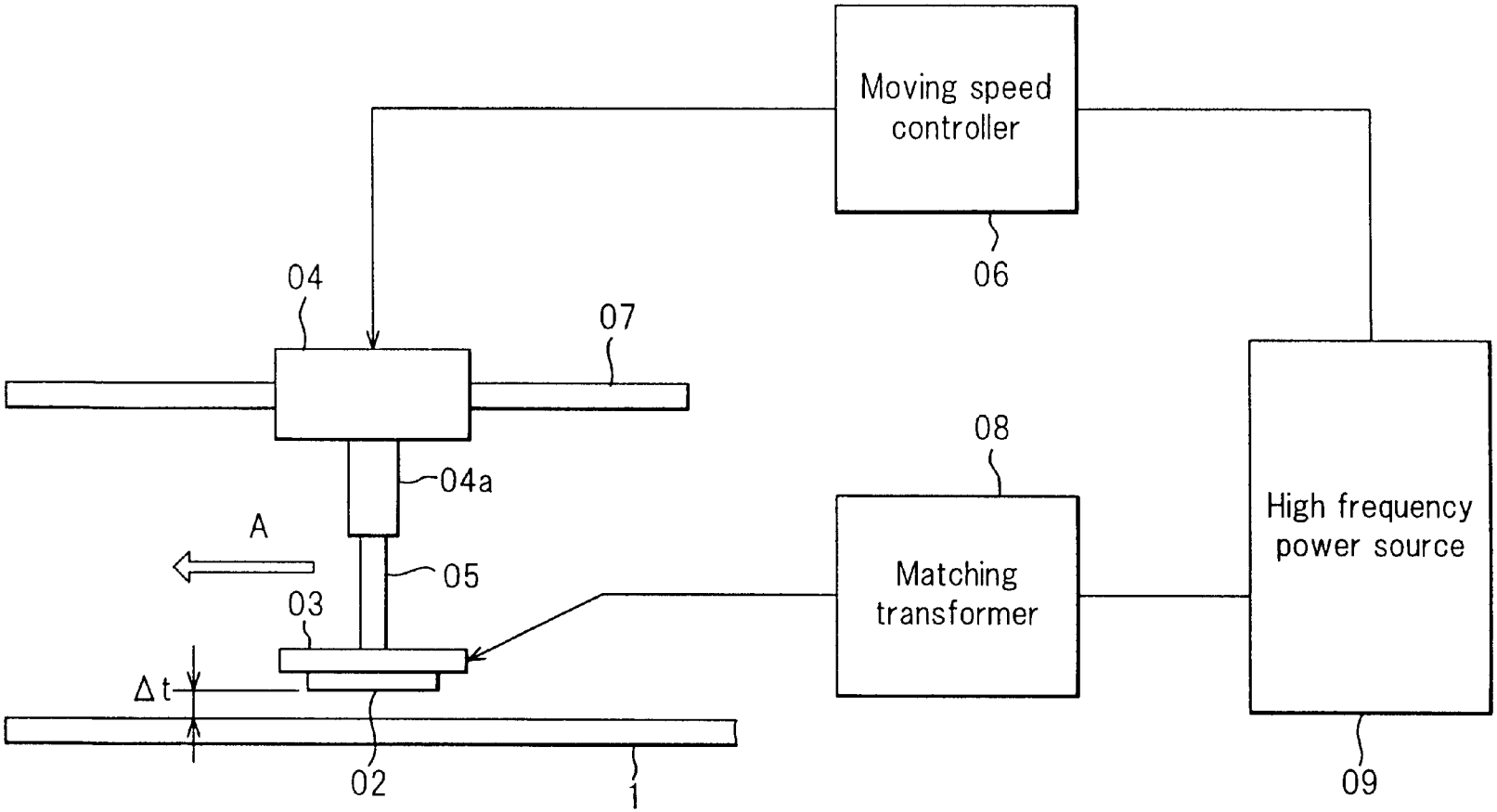
FIG. 4 PRIOR ART
FIG. 4 shows an explanation drawing conceptually showing a high frequency induction heater concerned with the earlier technology.
Figure 5A:
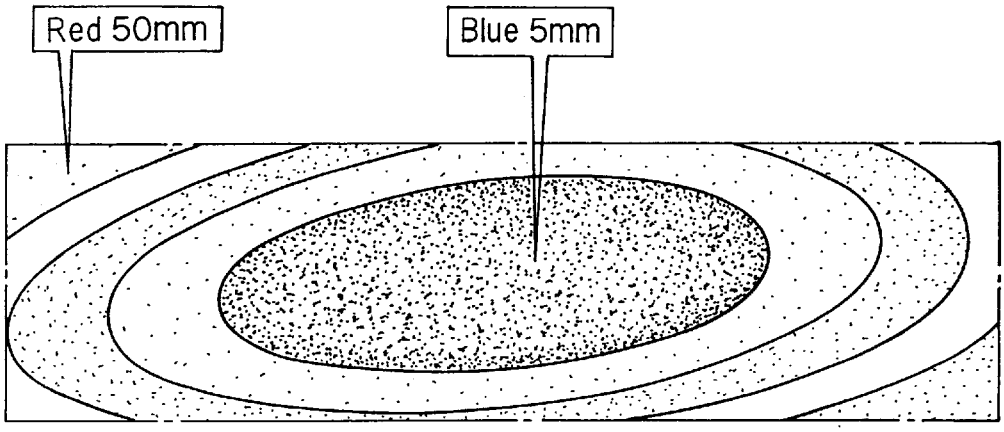
FIGS. 5(*a*) and 5(*b*) are schematic representations of the shape of a steel plate by contour lines for showing the results of experiments on the effects of the present invention.
Figure 5B:
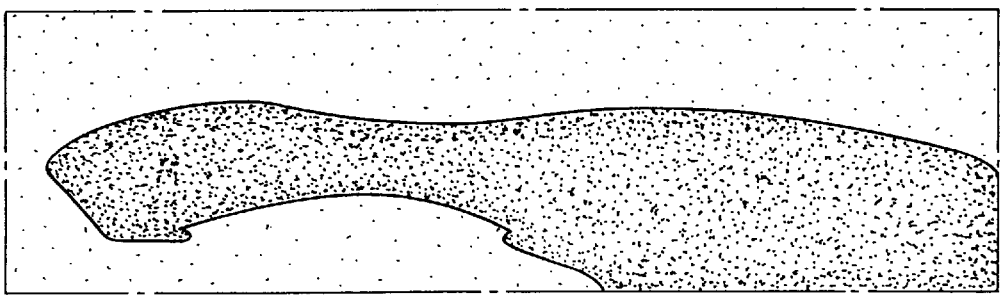
Figure 11:
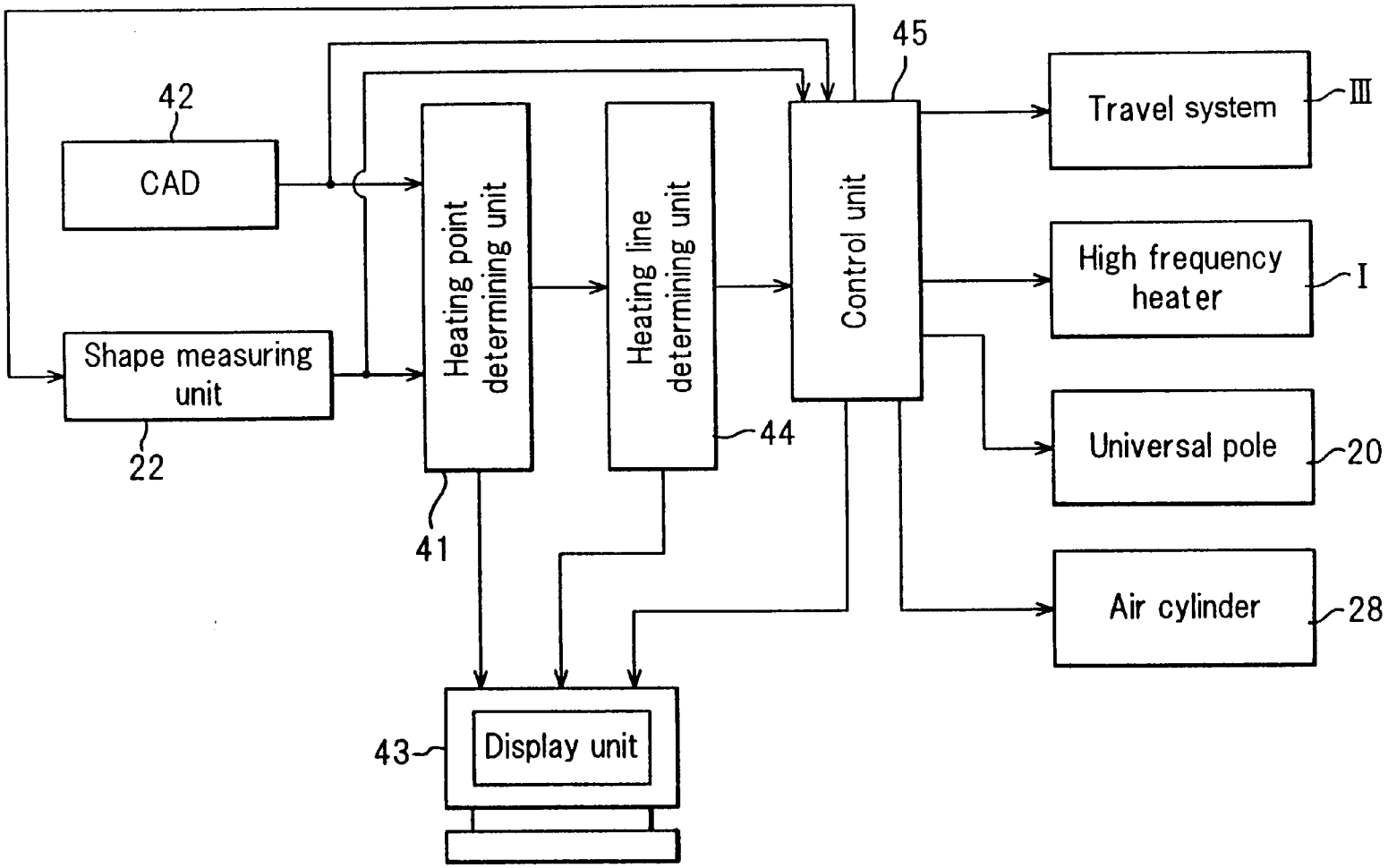
FIG. 11 is a block diagram showing a control system of the automatic plate bending system concerned with the instant embodiment.

FIG. 11 is a block diagram showing a control system of the automatic plate bending system concerned with the instant embodiment. As shown in FIG. 11, a heating point determining unit 41 reads data on the target shape and data on measurements of the steel plate, and performs predetermined processings (to be described in detail later on), thereby determining heating points on the steel plate 2. The target shape data are, for example, design data developed by CAD 42, and are given as three-dimensional coordinate data, while the steel plate measurement data are given as three-dimensional coordinate data on the steel plate 2 that have been obtained based on measurements by the shape measuring unit 22. A heating line determining unit 44 performs predetermined processings (to be described in detail later on) on the basis of information on the heating points determined by the heating point determining unit 41, thereby determining heating lines 3 on the steel plate 2 (see FIG. 3; the same will hold below) The heating lines 3 determined by the heating line determining unit 44 are sent to a control unit 45 as data comprising a sequence of points expressed in three-dimensional coordinates. The control unit. 45 controls the travel of the travel system III comprising the longitudinally traveling trolley 14 and the transversely traveling trolley 16 on the basis of the point sequence data on the heating lines 3, thereby to control theposition of the coil portion 24*b*, the heating means for the steel plate 2. Thus, induction heating of the steel plate 2 is performed with the coil portion 24*b* being moved along the heating lines 3, thereby bending the steel plate 2.

On this occasion, the control unit 45 performs the overall control of the system of the present invention, as well as the control of the travel system III. Concretely, its control includes, for example, control of an electric current for supply to the coil portion 24*b*, driving control for the air cylinder 28, control associated with the supply of cooling water, and positional control for the universal poles 20. During positional control of the universal poles 20, in particular, overbending of the steel plate 2 is also prevented. In detail, the control unit 45 performs control such that each universal pole 20 moves in response to changes in the shape of the steel plate 2 as the steel plate 2 is bent. Then, when any of the universal poles 20 after this responsive movement reaches a target front end position for each universal pole 20 that has been determined on the basis of the target shape data on the steel plate 2, a heating operation by the automatic plate bending system is stopped.

To carry out the above control for preventing excessive bending, the target shape of the steel plate 2 when contacted with the universal poles 20 must be made known beforehand. Thus, the control unit 45 stores not only the position of each universal pole 20 in a horizontal plane, the position of its front end portion, but also design data given by the CAD 42, and steel plate measurement data given by the shape measuring unit 22, as three-dimensional coordinates data. Based on these data, the control unit 45 calculates coordinates data on the target shape of the steel plate 2 at the position of contact of each universal pole 20 with the steel plate 2, to determine the target front end position of each universal pole 20.

The movement of the universal pole 20 in response to changes in the shape of the steel plate 2 can be easily achieved by controlling the front end position of the universal pole 20 so that the force of contact of the universal pole 20 with the steel plate 2 will become more than a predetermined value.

In an initial state of bending by the automatic plate bending system, not all of the universal poles 20 contact the steel plate 2. For the universal poles 20 out of contact with the steel plate 2, the above-mentioned control for responsive movement of the universal poles 20 is performed after the steel plate 2 contacts these universal poles 20 as the bending proceeds. In the initial state, the universal pole 20 has its front end position adjusted to agree with a curved surface corresponding to a bend of about 60% relative to the target shape of the steel plate 2. On the universal poles 20 in this state, the steel plate 2 subjected to primary cold bending by a bending roll or the like is placed by a rough positioning operation. Then, the first bending work by the automatic plate bending system is done, with a shape about 80% of the target shape being targeted.

A display unit 43 visualizes information associated with various processings by the automatic plate bending system, and also functions as an external input unit for entry of information necessary for processing.

Figures 12A, 12B, 12C, 12D, 12E:
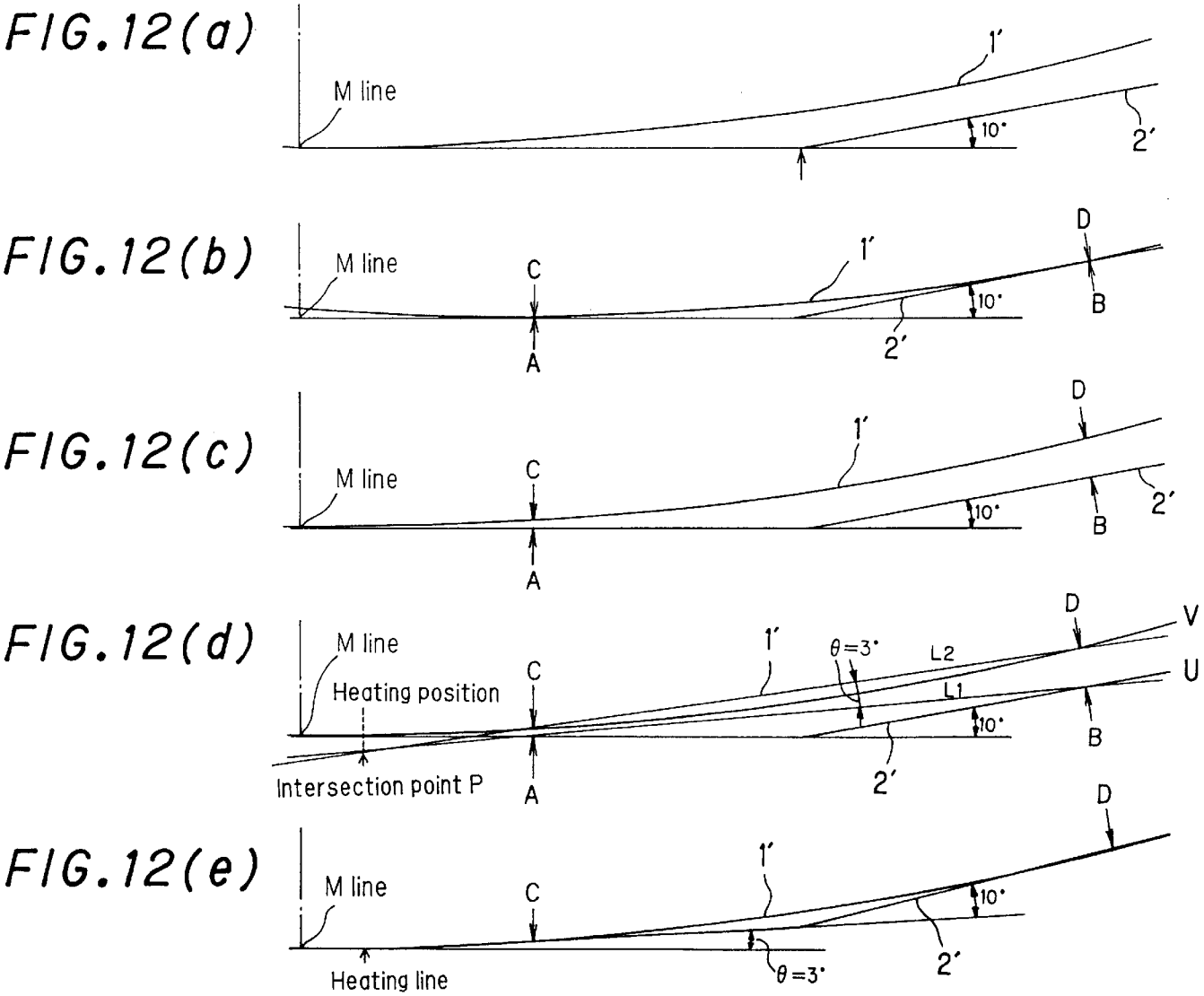
FIGS. 12(*a*) to 12(*e*) are explanation drawings for illustrating an example of processing performed by a heating point determining unit 41 in FIG. 11.

FIGS. 12 (*a*) to 12(*e*) are explanation drawings for illustrating an example of processing performed by the heating point determining unit 41. In these drawings, the numeral 1' denotes a virtual wooden pattern for illustration, and the numeral 2' represents a similar virtual steel plate. The term "virtual" refers to the fact that the wooden pattern or steel plate at issue does not exist as a real one, but exists as electronic data or a graphic expressed in a visible form on the display unit 43. The processing in this example, as has been done by an operator, is to find the points of contact of the wooden pattern 1' with the steel plate 2' while rolling the wooden pattern 1', to determine a heating point. Thus, we call this method "a contact point finding method".

As shown in FIG. 12(*a*), the steel plate 2', the object to be bent, is assumed to be one of a curved shape that has been subjected to primary bending. Such steel plate 2', when observed on a minuscule scale, is thought not to have a smoothly varying curved surface, but to be a collection of flat surfaces bent at certain linear sites. For example, as shown in FIG. 12(*a*), the steel plate 2' forms a flat surface in a certain range beginning on an M line, the centerline in the plate width direction, and is bent at a certain position $\tau$ to have an angle of 10°. On the other hand, a target shape that the wooden pattern 1' has is given as in FIG. 12(*a*). Thus, the wooden pattern 1' is rolled along a frame line from the initial position shown in FIG. 12(*a*), whereby the wooden pattern 1' is brought into contact with the steel plate 2' as shown in FIG. 12(*b*). At this time, contact points on the steel plate 2' are designated as A, B, while contact points on the wooden pattern 1' are designated as C, D. Then, the wooden pattern 1' is rolled in the reverse direction to return it to the initial state (the state shown in FIG. 12(*a*)) as shown in FIG. 12(*c*).

With the wooden pattern 1' being returned to the initial state, a straight line U connecting the con-tact points A, B and a straight line V connecting the contact points C, D are obtained to find an intersection point P of the straight lines U, V and an angle $\theta$ at which the straight lines U, V intersect. Based on this intersection point P, a heating point is determined. The angle $\theta$ (3° in FIG. 12) is deemed as a bending angle a the heating point. Actually, the intersection point E is extended vertically upward in FIG. 12 (*d*) until it reaches the steel plate 2', to determine a heating position. The steel plate 2' is heated at this heating position, whereby it is bent by the angle $\theta$, beginning at the heating position. This is a case shown in FIG. 12(*e*). As shown in this drawing, this heating results in the contact of the contact point B of the steel plate 2' with the contact point D of the wooden pattern 1', thus bringing the shape of the steel plate 2' close to the target shape (the shape of the wooden pattern 1'). Strictly speaking, there is a misalignment between the intersection point P and the heating position based thereon (there is a difference in the Z axis coordinate, the position in the vertical direction). In the bending at issue, however, the lengths of the straight lines U, V ranging from the intersection point P to the contact points B, D are sufficiently large relative to the angle $\theta$. Hence, there is practically no harm in handling the intersection point P and the heating position based thereon as the same position.

Then, the same procedure (the procedure shown in FIGS. 12(*b*) to 12 (*d*)) is performed, provided that the state of contact of the contact point C of the wooden pattern 1' with the contact point are presents a reference position corresponding to the aforementioned initial position. By this measure, a heating point and a bending angle $\theta$ at the heating point are determined. This procedure is repeated until the wooden pattern 1' is rolled to reach the end of the steel plate 2', whereby heating points and bending angles $\theta$ at the heating points are determined sequentially.

Figure 13A:
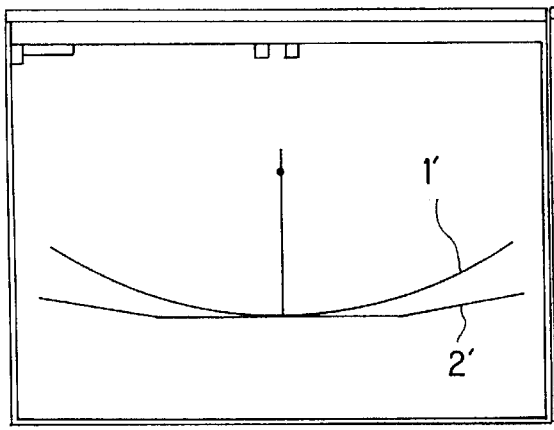
FIGS. 13(*a*), 13(*b*) and 13(*c*) are explanation drawings showing displays of a display unit 43 associated with processing performedby the heating point determining unit 41 in FIG. 11.
Figure 13B:
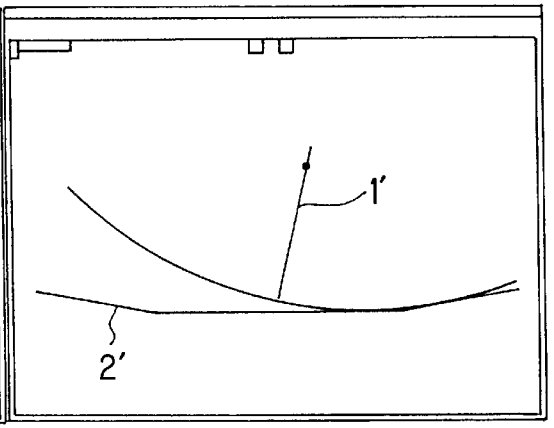
Figure 13C:
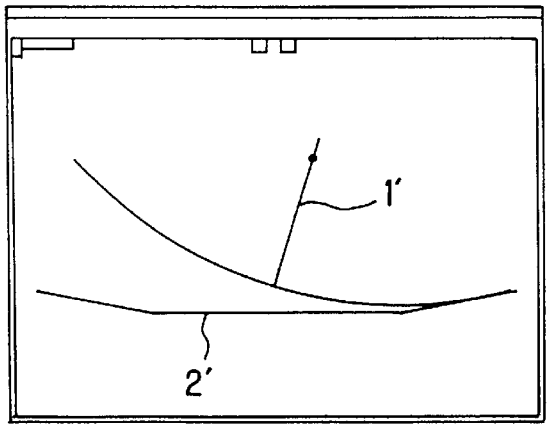

FIGS. 13(*a*) to 13(*c*) are explanation drawings conceptually illustrating display screens of the display unit 43 when the heating point is determined by the heating point determining unit 41. FIG. 13(*a*) corresponds to the initial position, FIG. 13(*b*) corresponds to a case in which the wooden pattern 1' is rolled once, and FIG. 13(*c*) corresponds to a case in which the wooden pattern 1' is rolled twice.

Figure 14:
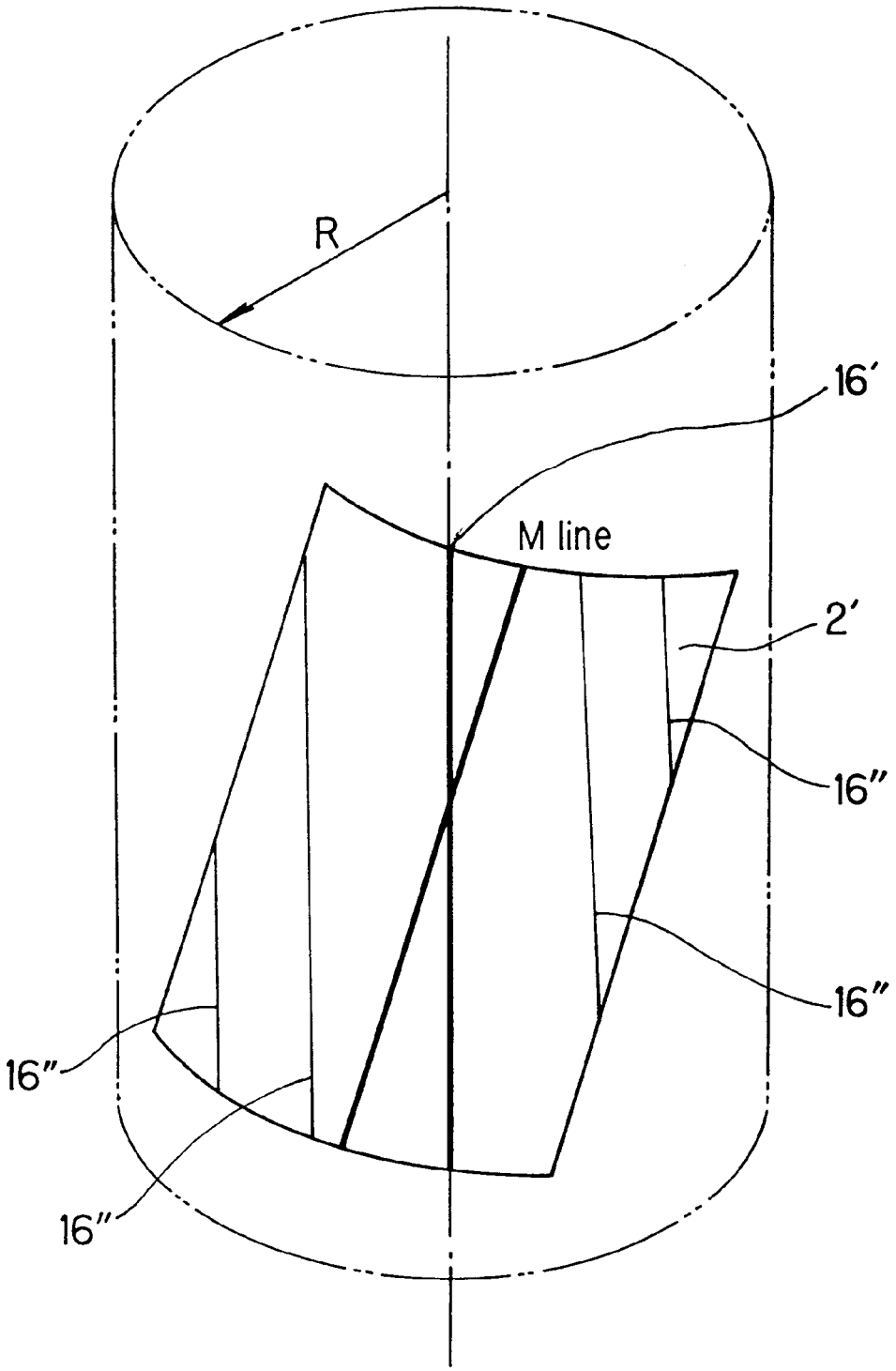
FIG. 14 is an explanation drawing conceptually showing the blank layout of a steel plate 2, an object to be processed, according to the instant embodiment.

FIG. 14 is an explanation drawing conceptually showing the blank layout of the steel plate 2, the object to be processed in the instant embodiment. As shown in FIG. 14, a virtual steel plate 2' which is a part of a cylindrical surface with a radius R taken out as in the drawing is assumed in the instant embodiment. To form this cylindrical surface approximately by bending, it is recommendable to bend the surface along the central axis of the cylinder so that its cross section is polygonal. That is, a roller reference line 16' is defined as indicating the direction of the central axis when the target shape is roughly deemed to be a cylindrical surface. FIG. 14 shows a case in which the M line, the centerline in the plate width direction, intersects the roller reference line 16'. The roller reference line 16' and the M line are not always in this relation. Since the steel plate 2' forms a part of the outer panel of a ship hull, for example, the roller reference line 16' and the M line may agree in a certain case.

Figure 15A:
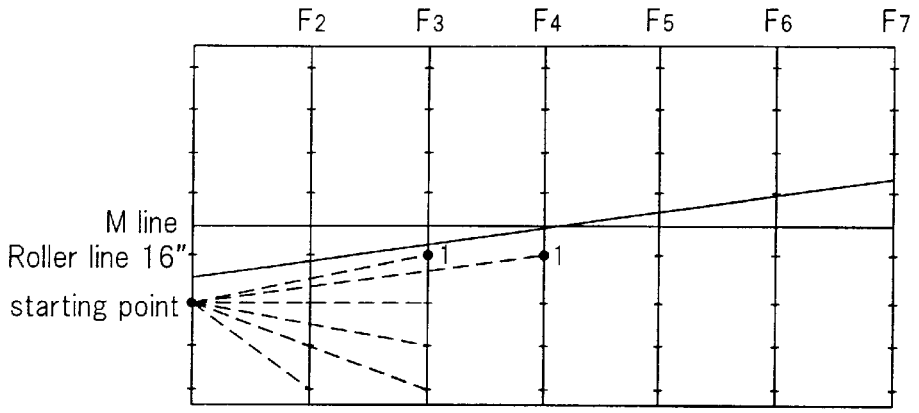
FIGS. 15(*a*)–15(*c*) are explanation drawings for illustrating an example of processing performed by a heating line determining unit 44 in FIG. 11.
Figure 15B:
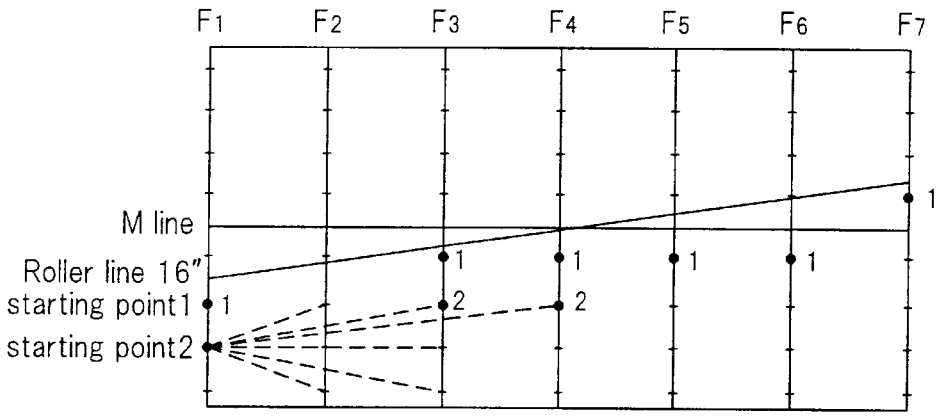
Figure 15C:
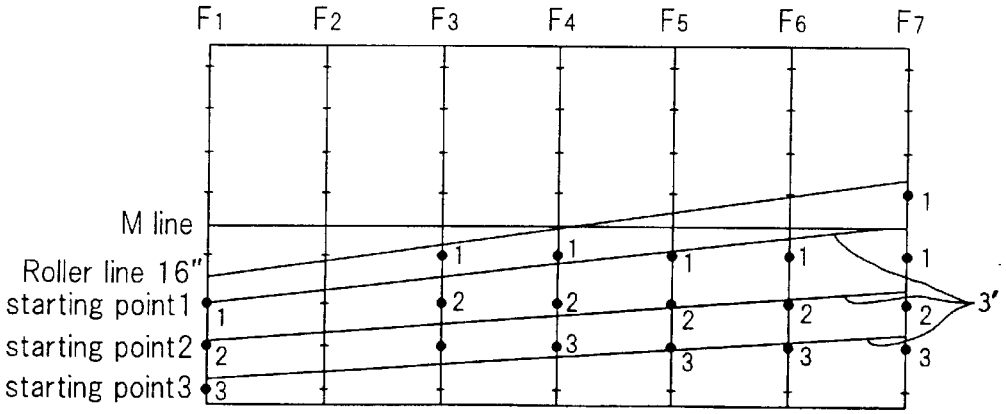

FIGS. 15(*a*), (*b*), and (*c*) are explanation drawings for illustrating an example of processing performed by the heating line determining unit 14. Determination of the heating line in this case is performed by connecting the heating points, which have been determined by the heating point determining unit 41, by a virtual straight line, examining the degree of parallelism between this straight line and a virtual roller line 16" drawn on a virtual steel plate 2', and grouping the heating points, whose straight lines show a predetermined degree of parallelism, into the same group. Grouping is performed while dividing the heating points into those above and those below the roller line 16". In FIG. 15, $F_1$ to $F_7$ represent virtual frame lines. The subscripts attached to the symbol F designate the frame line numbers. Many dots indicated narrowly at right angles to the respective frame lines $F_1$ to $F_7$ refer to the heating points.

As shown in FIG. 15(*a*), a starting point 1 is set first of all. From this starting point 1, virtual straight lines (indicated as dashed lines in FIG. 15) are drawn toward the heating points on the respective frame lines $F_1$ to $F_7$. The starting point is established on the frame line of a smaller frame line No. and at a site nearer to the roller line 16".

Then, the degree of parallelism, relative to the roller line 16", of each of the virtual straight lines drawn toward the heating points on the respective frame lines $F_1$ to $F_7$ is examined as stated above. The heating points that give the parallel lines or whose straight lines intersect the roller line 16" at angles no larger than a predetermined angle are grouped together into the same group. FIG. 15(*a*) shows that the heating points of the same group satisfying the requirement for the degree of parallelism based on the starting point 1 are present on the frame lines $F_3$, $F_4$. Upon completion of grouping based on the starting point 1, grouping based on a starting point 2 is performed in accordance with the same procedure, as shown in FIG. 15(*b*). FIG. 15(*b*) shows that the heating points belonging to Group 1 based on the starting point 1 have been fixed, and the heating points based on the starting point 2 are being investigated. On this occasion, the heating points that have already been grouped are neither used as the starting points nor subjected to grouping. In this manner, the heating points lying below the roller line 16" are grouped. After grouping work is completed, a straight line (or a curve) is obtained from the sequence of heating points in each group, as shown in FIG. 15(*c*), and this line is designated as a virtual heating line 3'. The heating line 3' is obtained by the method of least squares if it is a straight line, or by spline interpolation or the like if it is a curve.

Figure 16:
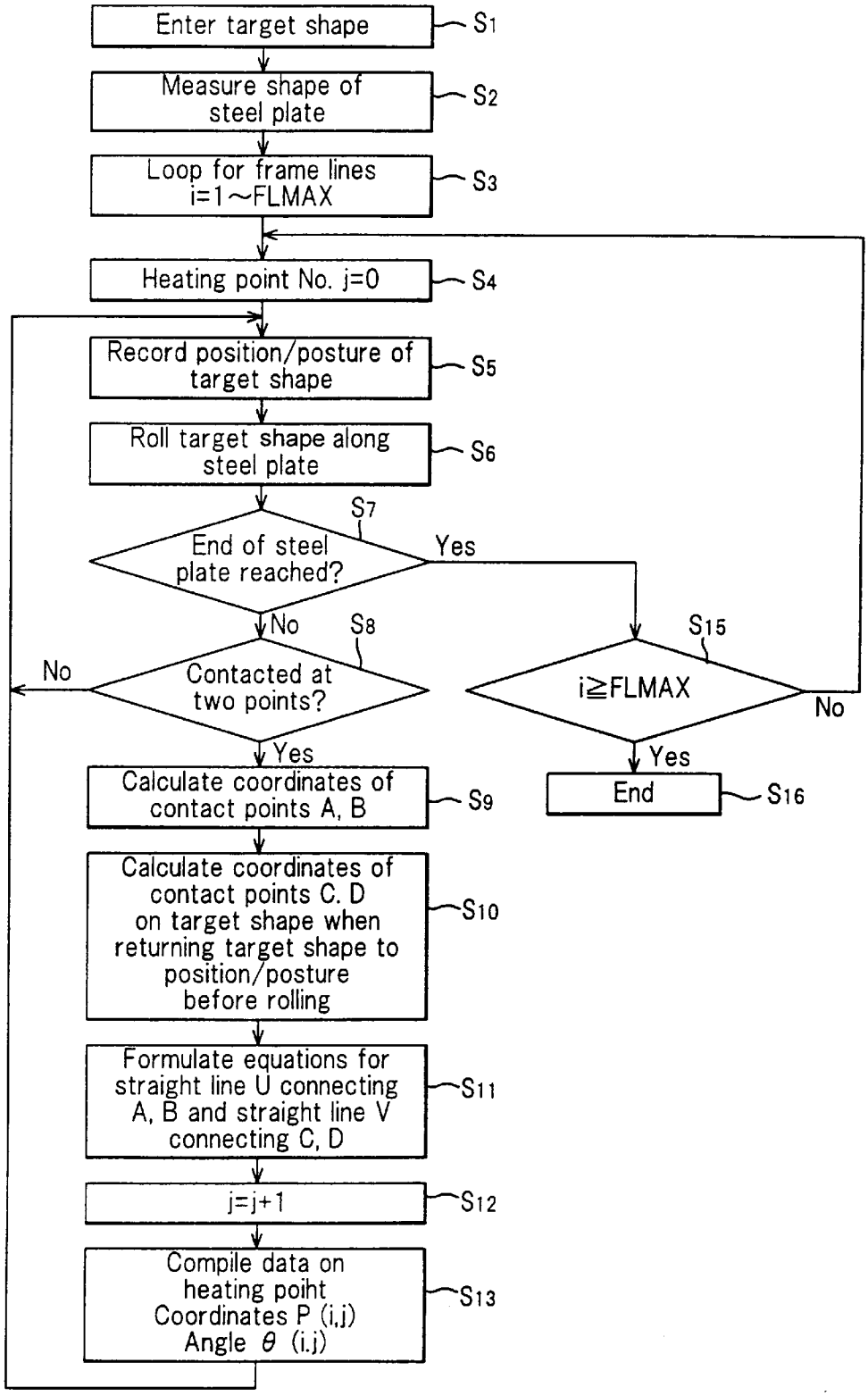
FIG. 16 is a flow chart showing an example for determination of heating points.

FIG. 16 is a flow chart showing a concrete procedure (example) using the heating point determining unit 41 when obtaining the heating points by the contact point finding method. In the instant embodiment, the heating points are obtained on the frame lines, but needless to say, the way of obtaining them is not restricted to this manner. However, the frame lines are lines corresponding to the positions at which frame materials are attached. Thus, data on their positions are stored as design data. The use of the frame lines in obtaining the heating points is advantageous in the applicability of such data. The above-mentioned procedure will be explained based on FIG. 16.

1) Design data such as CAD data are loaded to enter the target shape of the steel plate as three-dimensional data (step $S_1$).

2) The shape of the steel plate, the object to be processed, is measured to obtain three-dimensional coordinate data thereon (step $S_2$). This can be easily performed by an existing measuring method, such as laser measurement or image processing of an image shot with a camera.

3) The processings at step $S_4$ through step $S_{14}$ are performed for the respective frame lines (step $S_3$). The expression "Loop . . . " indicated in the block for step $S_3$ refers to an operation in which the processings subsequent to the step at issue (in this case, step $S_3$) are deemed to be one loop, and the processings belonging to this loop are sequentially repeated for each frame line, as in the instant embodiment (the same will hold later on). At step $S_3$, the frame line No. i is designated as "1", and the flow moves to the processing at a next step $S_4$. "FLMAX" means the maximum frame line No. (the same will hold later on)

4) Since no heating point exists initially, j=0 is set as the initial value of the heating point No. (step $S_4$).

5) The position and posture of the target shape are recorded (step $S_5$). Concretely, records are made, for example, of the coordinates of the reference point of the target shape (the point of intersection between a curve of the frame line showing the target shape and a sight line, i.e., the point of the virtual wooden pattern showing the M line), and the inclination of the sight line (the inclination angle based on the horizontal line or the vertical line). The state on this occasion corresponds to the initial state in which during an operation using a conventional wooden pattern, an operator places the middle point of a portion of the wooden pattern extending along the target shape on the M line of the steel plate, and holds the sight line vertically.

6) The target shape is rolled along the steel plate (step $S_6$), and its rolling is repeated until the target shape reaches the end of the steel plate (step $S_7$). When the target shape and the steel plate are detected to have contacted at 2 points during the rolling ($S_8$), the processing described in the aforementioned "principle of the contact point finding method" is performed to determine the coordinates of the intersection point E and its angle θ (steps $S_9$, $S_{10}$, $S_{11}$ and $S_{12}$).

7) "1" is added to the heating point No., and data on the respective heating points on specific frame lines are compiled (steps $S_{13}$ and $S_{14}$). These data on the heating points are given as three-dimensional coordinate and angle data with the respective frame line Nos. and the respective heating point Nos. specified.

8) When it is detected at the judging step (step $S_7$) that the end of the steel plate has been reached, it is judged whether the frame line No. at this time is larger than the maximum value of the number of the frame lines (FLMAX) for which the heating point determining processings are performed. If the frame line No. i<FLMAX, the processings at steps $S_4$ to $S_{14}$ are repeated for the frame line of the next No. Whenever the flow returns to step $S_4$, "1" is added to the frame line No. i. If the frame line No. i≧FLMAX, this means that the predetermined processings for obtaining the heating points have been completed for all the frame lines. Thus, the heating point determining processings are ended (steps $S_{15}$ and $S_{16}$).

9) When it is not detected by the processing at step $S_8$ that no contact at 2 points has been made, the flow returns to the processing at step $S_5$, and the processing at steps $S_5$ to $S_7$ are repeated. That is, the target shape is rolled at a certain angle by a single processing, and the processings at steps $S_5$ to $S_7$ are repeated until contact at 2 points is detected. Thus, if the shape of the steel plate extending along the frame line for which the heating points are to be determined is a flat plane, it is detected by the processing at step $S_7$ that the end of the steel plate has been reached with no contact point being determined. Thus, a judgment is made that no heating point exists for this frame line, and the flow moves to the processing for the next frame line. If no contact at 2 points has been detected for all the frame lines, namely, if the entire steel plate is of a flat shape, no heating points can be determined by the "contact point finding method". Thus, the steel plate for which heating points should be determined by this method must have been subjected to primary bending with a bending roll or the like.

According to the processing at step $S_6$, the target shape is rolled along the steel plate, but the same effect is obtained if the steel plate is rolled along the target shape. In short, one of them may be rolled relative to the other so that the contact point of the two is obtained. The purpose of determining the heating points in the above manner is to obtain the heating positions and heating intensities (quantities of heat given to the steel plate) for causing the necessary change in shape. Between the heating intensity and the angle θ, there is a predetermined relationship, which can be found experimentally. Thus, at a time when the angle θ is found, the heating intensity can be determined (needles to say, if the angle θ is recorded as data, it can be converted to the heating intensity later, where necessary). Thus, at step $S_{14}$, the heating intensity with respect to the angle θ may be obtained along with data on the angle θ, although this is not directly related to the processing for finding the heating point.

FIGS. 17 to 20 are flow charts showing a concrete procedure (example) using the heating line determining unit 44 when obtaining the heating lines on the basis of the heating points determined. This procedure will be explained based on these drawings.

Figure 17:
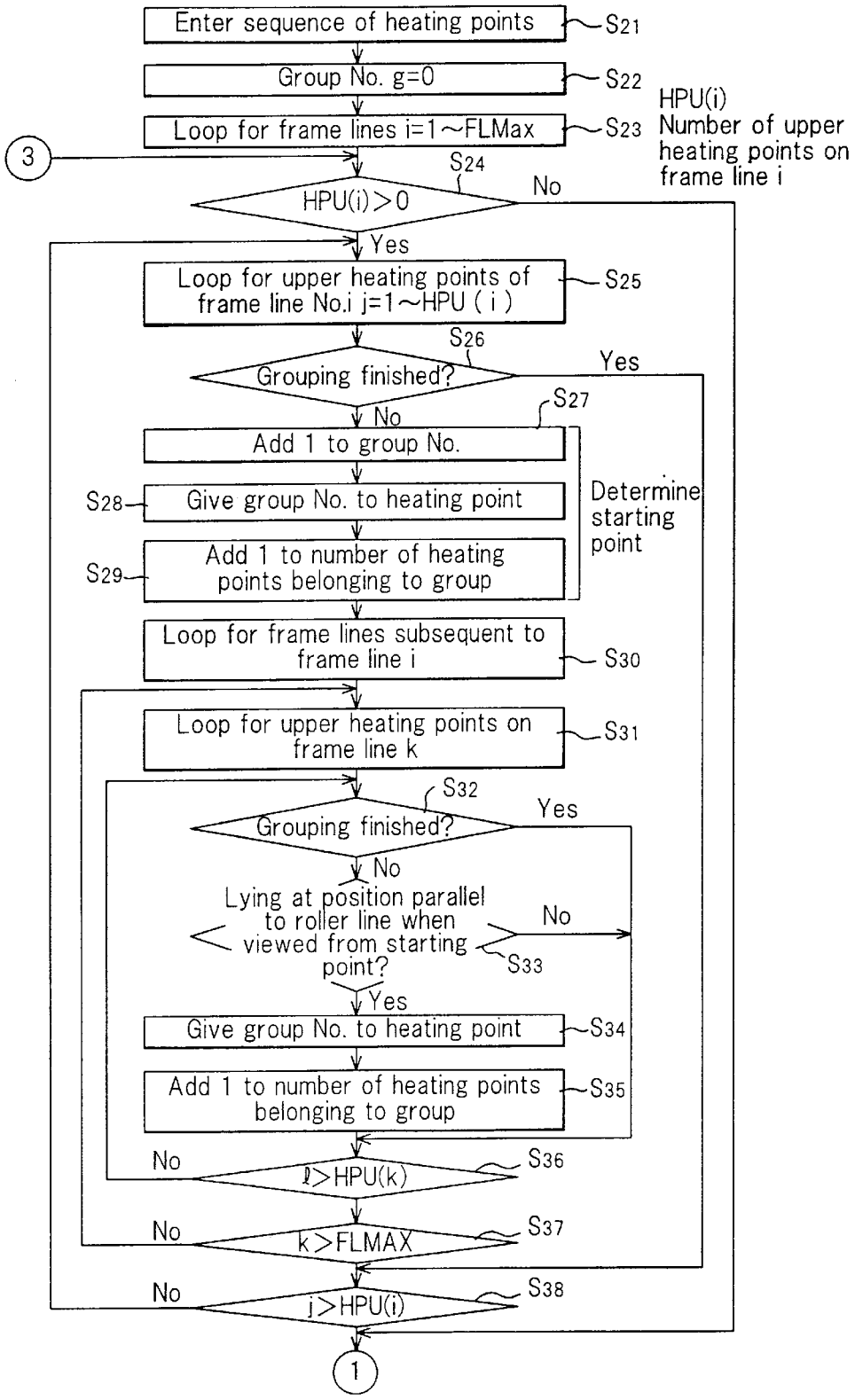
FIG. 17 is a flow chart 1 showing a first example for determination of heating lines.

The following processings are performed as shown in FIG. 17:

1) Data on the heating points are entered (step $S_{21}$). Concretely, entry is made of the three-dimensional coordinate and angle data on the respective heating points on the respective frame lines that have been obtained at step $S_{14}$ of FIG. 16.

2) Since no predetermined group is formed initially, g=0 is set as the initial value of the group No. g (step $S_{22}$).

3) The processings at steps $S_{24}$ to $S_{54}$ are performed for the respective frame lines (step $S_{23}$).

4) It is judged whether the number of the upper heating points on the frame line of the frame line No. i is HPU(i)>0 (step $S_{24}$). "The number of the upper heating points, HPU" means the number of the heating points above the roller line 16" found when it is determined whether the heating point is above or below the roller line 16". For example, the heating point with a larger Y coordinate than that of the point of intersection of each frame line and the roller line 16" is regarded as the upper heating point. Thus, if the upper heating point exists, HPU(i)>0. In this case, the flow moves to the processing at step $S_{25}$.

5) The processings at steps $S_{26}$ to $S_{38}$ are performed for the respective upper heating points on the frame line of the frame line No. i (step $S_{25}$). That is, the same processings are carried out for the respective heating points of the heating point Nos. j=1~HPU(i) to perform their grouping.

6) It is judged whether grouping is finished or not (step $S_{26}$). Concretely, it is judged whether the group No. g is assigned to the heating points that are being judged.

7) When the judgment at step $S_{26}$ shows that the heating points, the objects being judged, have not been grouped, "1" is added to the group No. g (step $S_{27}$). Since the initial value of the group No. g is "0", the group No. g=1 is given at the processing for the first heating point concerned with the first frame line.

8) The heating point, the object being processed, is given the group No. g assigned at step $S_{27}$ (step $S_{28}$).

9) The number of the heating points belonging to the group is designated as "1" (step $S_{29}$).

10) A starting point is determined by the processings at steps $S_{27}$ to $S_{29}$.

11) The processings at steps $S_{31}$ to $S_{37}$ are performed for the respective frame lines of the frame line Nos. i later than the frame line No. i (step $S_{30}$). These frame line Nos. are k=(i+1)~FLMAX.

12) The processings at steps $S_{32}$ to $S_{36}$ are performed for the respective upper heating points on the frame line of the frame line No. k (step $S_{31}$).

13) It is judged whether grouping of the specific heating points on the frame line of the frame line No. k is finished or not (step $S_{32}$). Concretely, it is judged whether the group No. g is assigned to the heating point being judged.

14) When the judgment at step $S_{32}$ shows that the heating point being judged has not been grouped, it is judged whether this heating point is at a position parallel to the roller line 16" when viewed from the starting point (step $S_{33}$). For example, the heating point as the starting point and the heating point as the object being judged are connected together by a straight line, and the angle of this straight line to the roller line 16" is detected. If this angle is less than a predetermined value, a judgment is made that the heating point in question is at a parallel position. Alternatively, the same judgment can be made by measuring the distance between each end of the straight line and the roller line 16", and detecting whether the distances measured are each within a certain range.

15) When the judgment at step $S_{33}$ shows that the heating point being judged lies at a position parallel to the roller line 16", this heating point is assigned the same group No. g as that of the heating point as the starting point (step $S_{34}$).

16) "1" is added to the number of the heating points of the group No. g assigned at step $S_{34}$ (step $S_{35}$).

17) When the processing at step $S_{35}$ is completed, or when grouping of the heating points being judged by the processing at step $S_{32}$ is completed, or when the absence of a predetermined degree of parallelism is detected by the processing at step $S_{33}$, the processings at steps $S_{32}$ to $S_{35}$ are repeated (step $S_{36}$) until the heating point No. 1 of the heating point being judged as belonging to the frame line of the frame line No. k becomes larger than the maximum value HPU(k). Whenever the flow returns froms tep $S_{36}$ to step $S_{32}$, "1" is added to the heating point No. In this manner, grouping of the heating points on the specific frame line is performed.

18) When it is detected by the processing at step $S_{36}$ that grouping of all the upper heating points on the frame line of the frame line No. k is completed, the processings at steps $S_{31}$ to $S_{36}$ are repeated until the frame line No. k becomes larger than the maximum value FLMAX (step $S_{37}$). Whenever the flow returns from step $S_{37}$ to step $S_{31}$, "1" is added to the frame No. k. In this manner, grouping of the upper heating points for all the frame lines of the frame line Nos. later than i is performed.

19) When it is judged by the processing at step $S_{26}$ that grouping of the heating points, the objects being judged, on the frame line of the frame line No. i has been finished, or when it is detected by the processing at step $S_{37}$ that grouping of the upper heating points for all the frame lines of the frame line Nos. later than i has been finished, the processings at steps $S_{26}$ to $S_{38}$ are repeated (step $S_{38}$) until the heating point No. j of the heating point being judged as belonging to the frame line of the frame line No. i becomes larger than the maximum value HPU(i). Whenever the flow returns from step $S_{38}$ to step $S_{26}$, "1" is added to the heating point No. In this manner, grouping of the upper heating points on the frame line of the frame line No. i is performed.

Figure 18:
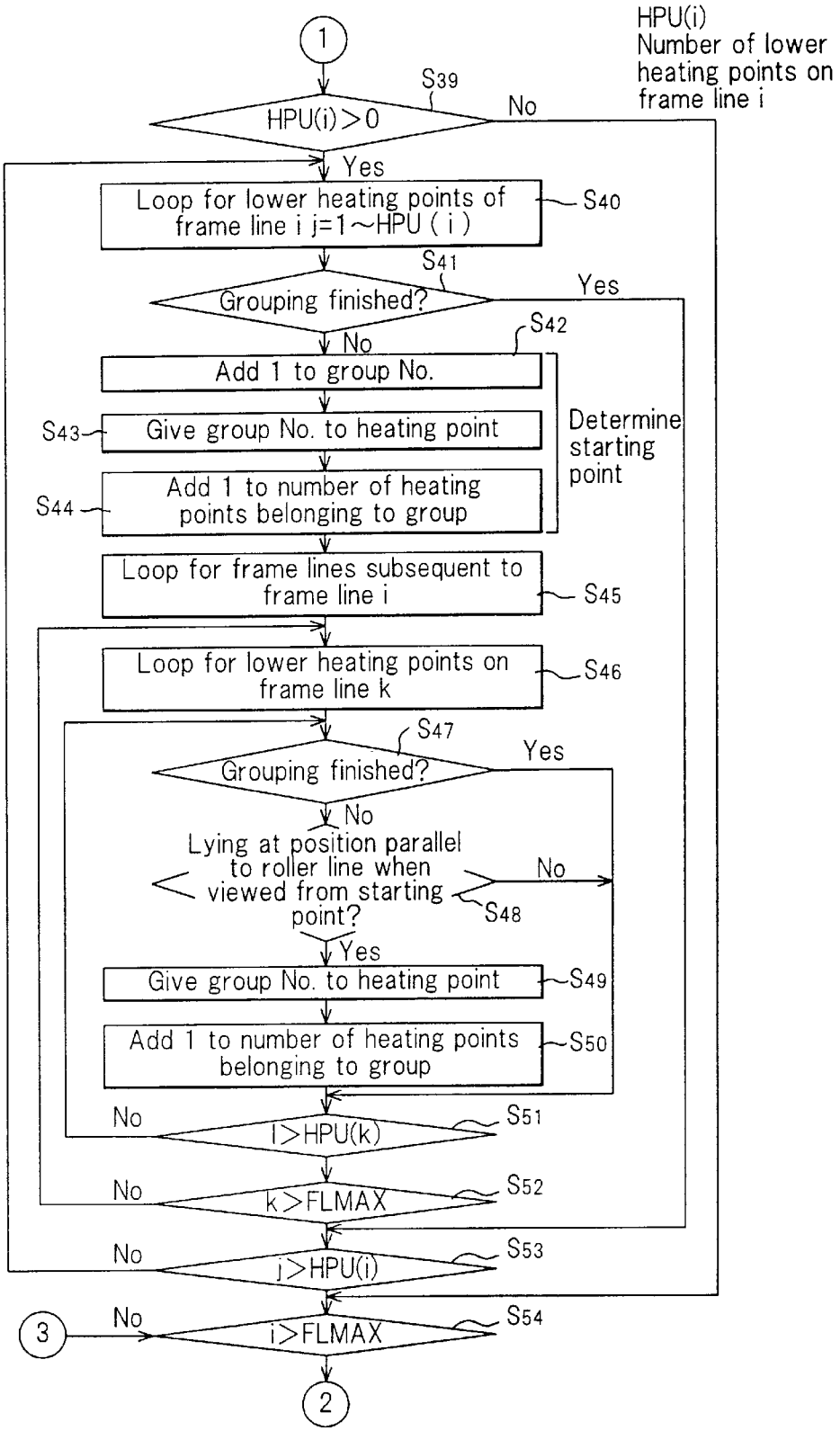
FIG. 18 is a flow chart 2 showing the first example for determination of heating lines.

As shown in FIG. 18, the following processings are performed:

20) When it is detected by the processing at step $S_{24}$ that no upper heating points exist on the frame line of the frame line No. i, or when it is detected by the processing at step $S_{38}$ that grouping of all the upper heating points on the frame line where the starting point belongs is completed, grouping of the lower heating points on each frame line is performed by exactly the same procedure. That is, the processings at steps $S_{39}$ to $S_{53}$ corresponding to the processings at steps $S_{24}$ to $S_{38}$ are performed for the lower heating points. At step $S_{39}$, "the number of the lower heating points, HPL" refers to the number of the heating points that is in contrast to the upper heating points when it is determined whether the heating point is above or below the roller line 16". In other words, HPL means the number of the heating points below the roller line 16". For example, the heating point with a smaller Y coordinate than that of the point of intersection of each frame line and the roller line 16" is regarded as the lower heating point.

21) When it is detected by the processing at step $S_{39}$ that no lower heating points exist on the frame line of the frame line No. i, or when it is detected by the processing at step $S_{53}$ that grouping of all the lower heating points on the frame line where the starting point belongs is completed, it is judged whether the frame line No. is larger than FLMAX. If it is smaller, the processings at steps $S_{24}$ to $S_{53}$ are repeated for each frame line. When these processings are completed for all the frame lines, i.e., when grouping of all the heating points belonging to all the frame lines is completed, the flow moves to the next processing (step $S_{54}$).

Figure 19:
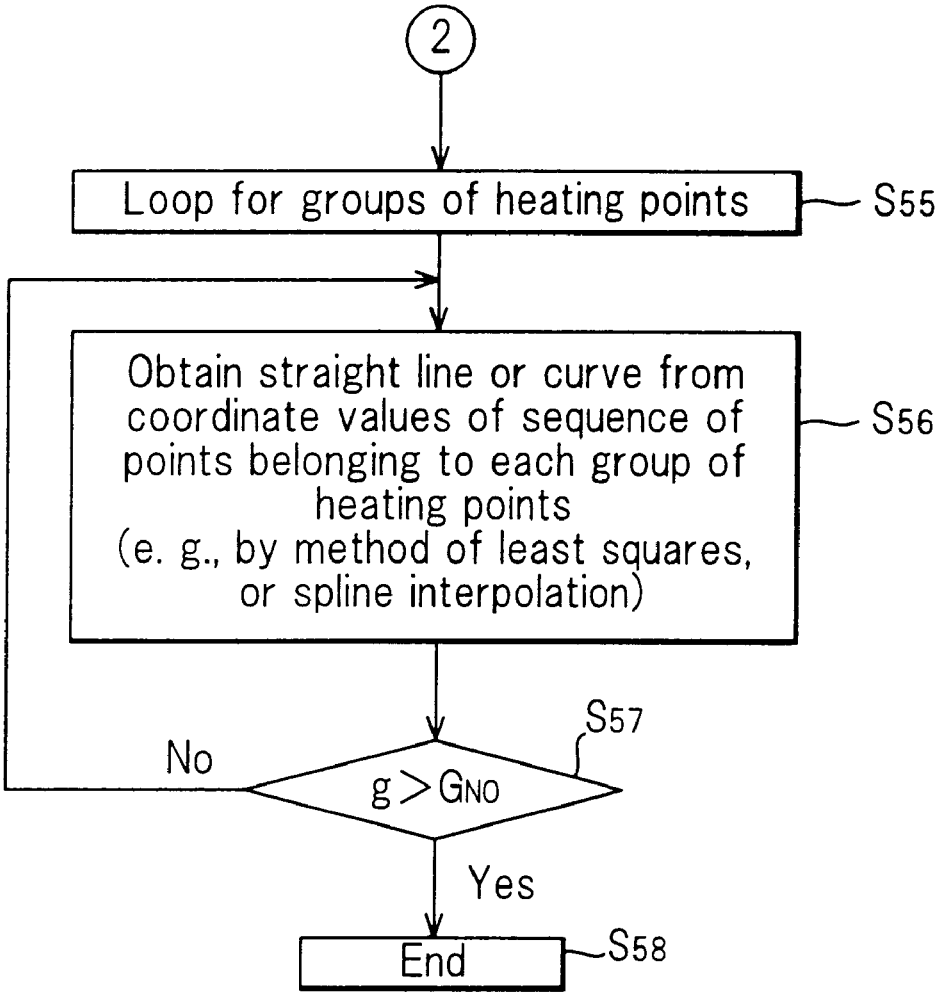
FIG. 19 is a flow chart 3 showing the first example for determination of heating lines.

As shown in FIG. 19, the following processings are performed:

22) For each heating point group established, the heating points of each group are sequentially connected together by a straight line, or a straight line or a curve is calculated by the method of least squares, spline interpolation or the like based on the coordinate values of the heating points, thereby to obtain a heating line (steps $S_{55}$ and $S_{56}$). At step $S_{55}$, "$G_{NO}$" refers to the maximum value of the number of the groups.

23) When it is detected that the group No. $\geqq G_{NO}$, i.e., when it is detected that the heating lines 3 have been determined for all the groups, all the processings are completed (steps $S_{57}$ and $S_{58}$).

Figure 20:
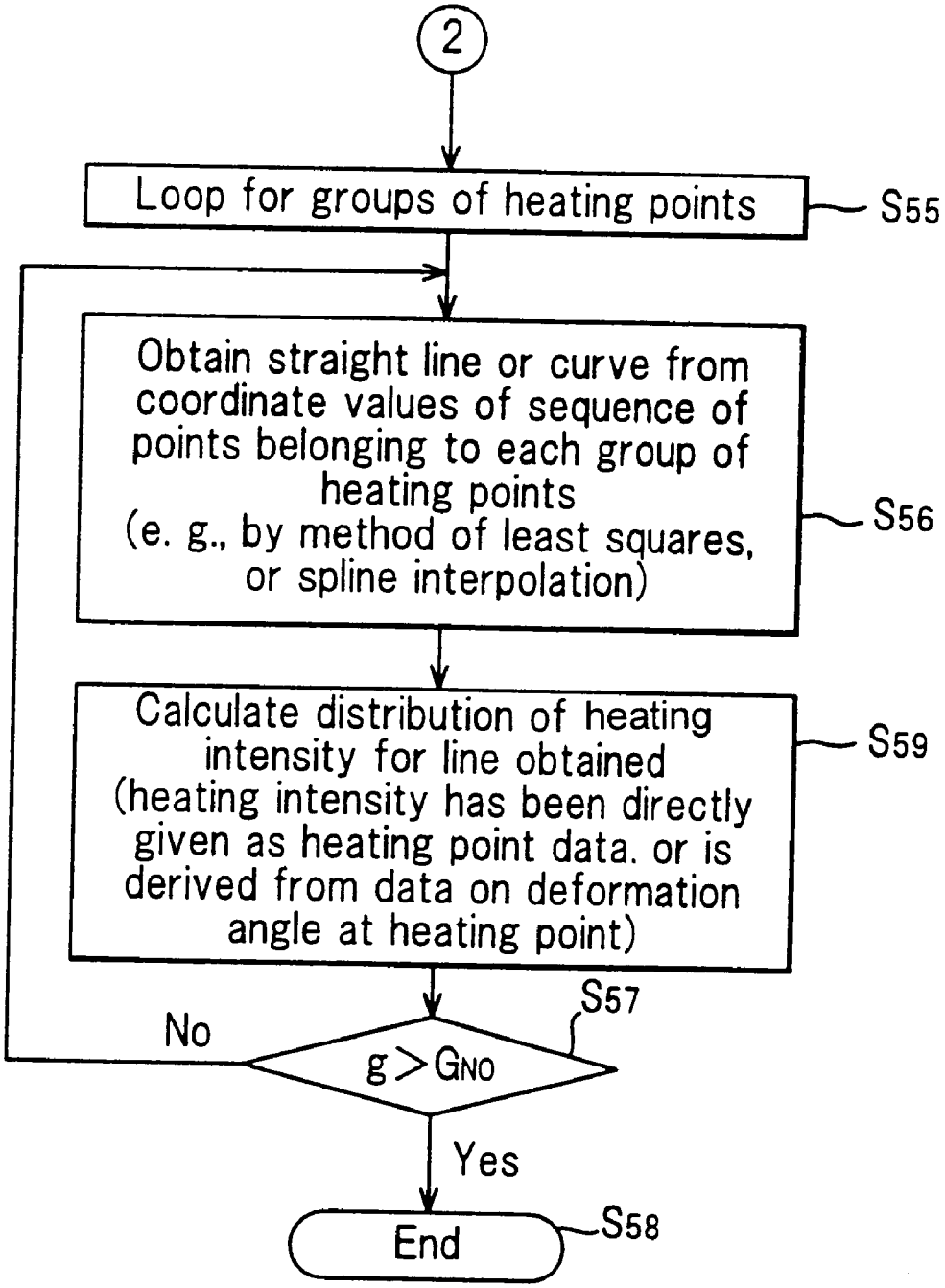
FIG. 20 is a flow chart showing part of a second example for determination of heating lines.

FIG. 20 shows an example in which the heating intensity (determined by the bending angle θ) at each heating point is taken into consideration during the processings shown in FIG. 19, and the information on the heating intensity is incorporated into the information on the heating line. As shown in FIG. 20, the distribution of the heating intensity is calculated for the determined heating line by the process subsequent to step $S_{56}$ in accordance with the instant embodiment (step $S_{59}$). The heating intensity has been directly obtained separately based on the bending angle θ at the heating point, or is determined on the basis of information on the bending angle θ at the heating point.

According to the instant embodiment, the heating points on each heating line 3 can be heated with the most appropriate quantity of heat. In the case of bending by high frequency heating, for example, this can be easily achieved by controlling an electric current supplied to the high frequency heating coil to control the amount of heat input to the steel plate 2.

Figure 21:
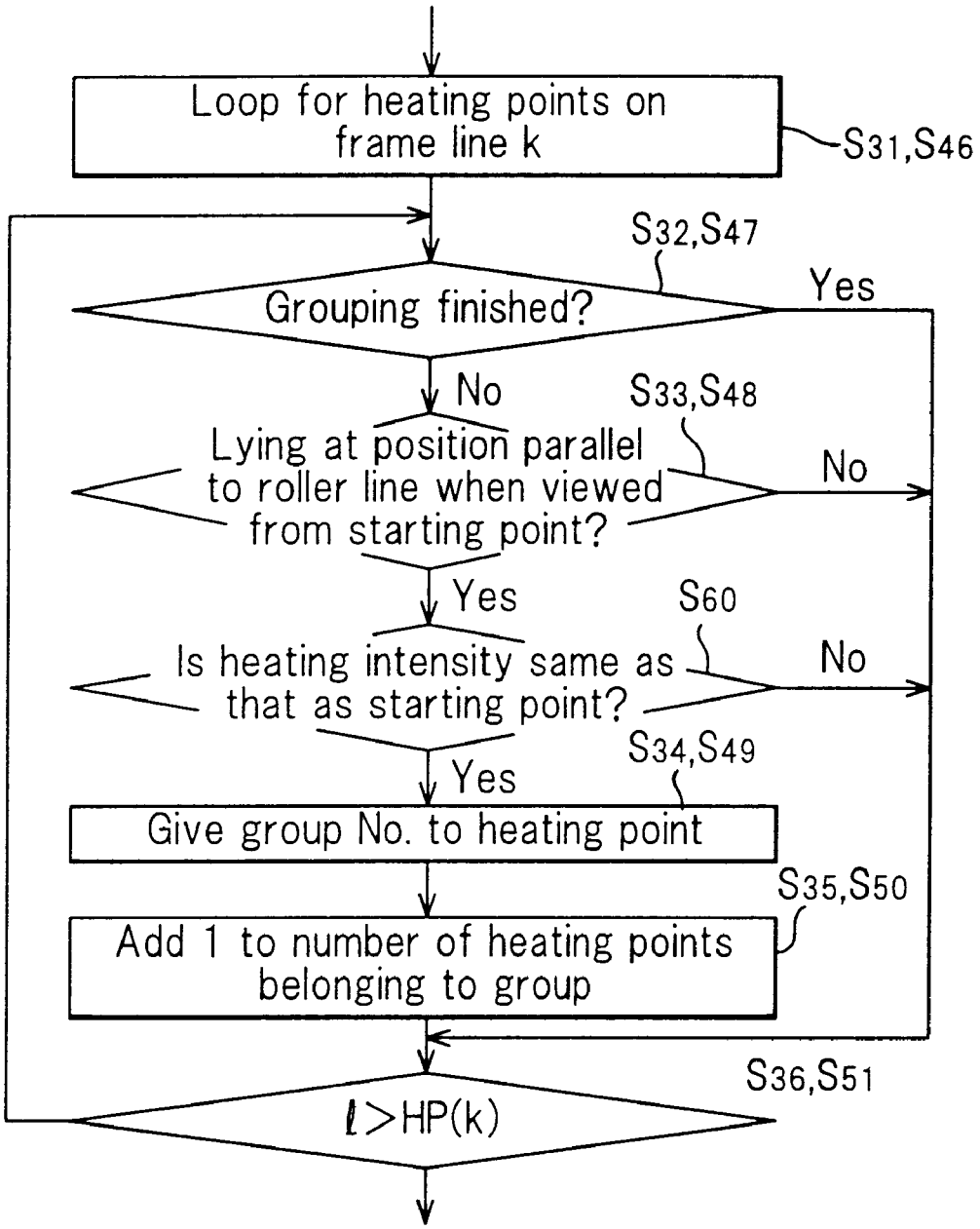
FIG. 21 is a flow chart showing part of a third example for determination of heating lines.

FIG. 21 shows an example in which the heating intensity (determined by the bending angle θ) at each heating point is taken into consideration during the processings illustrated in FIGS. 17 and 18, and this heating intensity is also incorporated into the conditions for grouping. As shown in FIG. 21, in accordance with the instant embodiment, it is judged by the processing subsequent to step $S_{33}$ or step $S_{48}$ whether the heating intensity is same as the heating intensity at the starting point (the heating intensity includes that within a predetermined tolerance range) (step $S_{60}$). If this judgment shows that the heating point in question does not have the same heating intensity, this heating point is excluded from the relevant group. In other words, the same group No. as that of the starting point is assigned to the heating point, provided that it has the same heating intensity.

According to the instant embodiment, the heating points on each heating line 3 can be heated with the same quantity of heat. In the case of bending by high frequency heating, for example, the most appropriate amount of heat input to the steel plate can be given by keeping the electric current supplied to the high frequency heating coil constant for a single heating line 3.

In the above-described embodiments, the term "virtual" has been defined as not existing as a real one, but existing as electronic data or a graphic expressed in a visible form on the display unit 43. However, such a restriction need not be applied to the technical idea of the present invention. A wooden pattern and a steel plate which an operator prepares by plotting are also included in the concept "virtual" as referred to herein, unless they are real ones.

Figure 22:
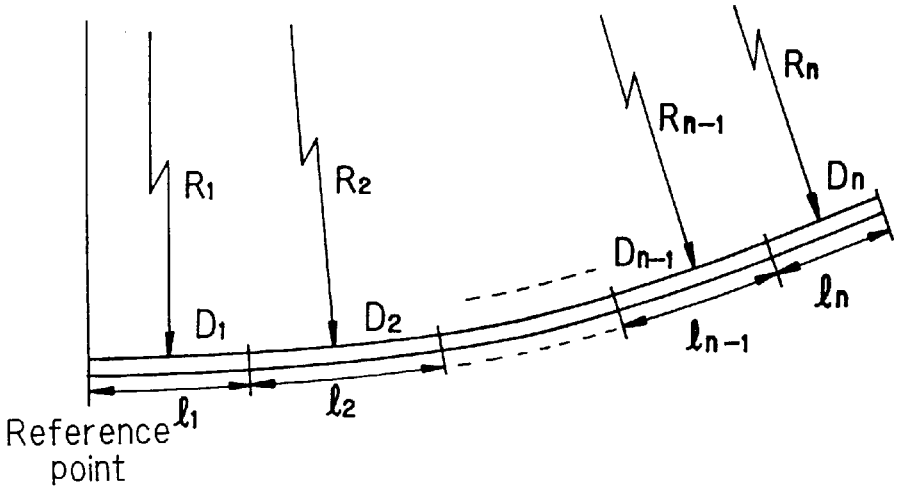
FIG. 22 is an explanation drawing for illustrating the principle of a curvature comparison method which is processing performedby the heating point determining unit 41 in FIG. 11 (a state in which the curve of a target shape is divided into fine zones that constitute arcs with radii of $R_1$ to $R_n$)
Figure 23:
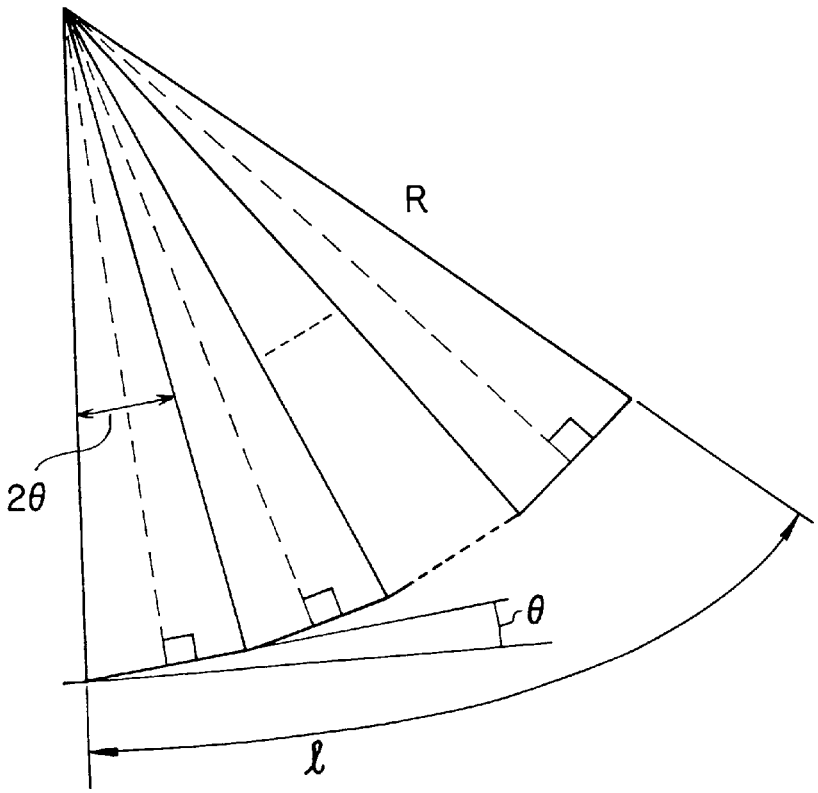
FIG. 23 is an explanation drawing for illustrating the principle of the curvature comparison method which is processing performed by the heating point determining unit 41 in FIG. 11 (a state in which one of the arcs of FIG. 22 is approximated by a fold line defined by the bases of a plurality of isosceles triangles connected together while sharing their equal sides)
Figure 24:
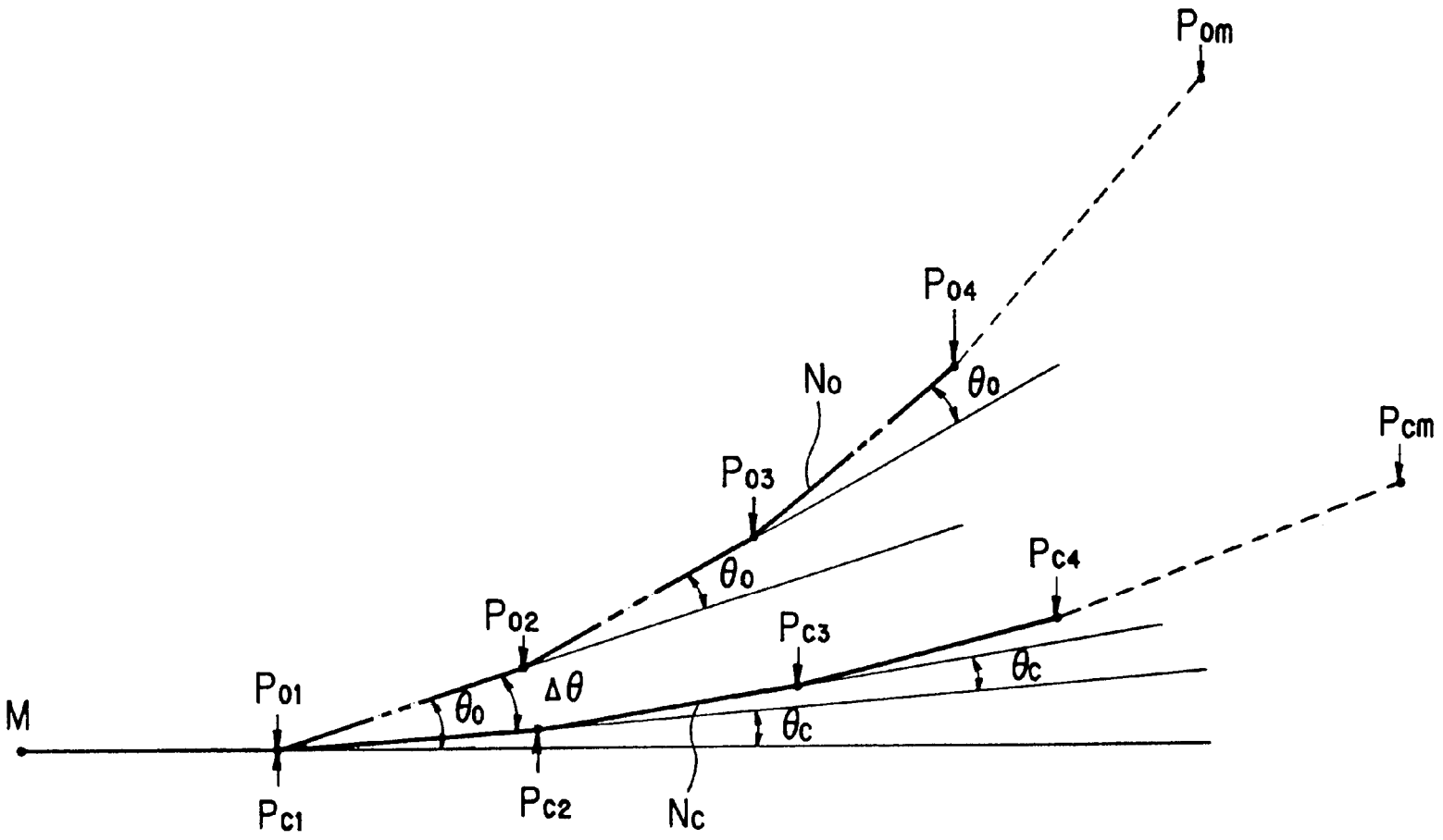
FIG. 24 is an explanation drawing for illustrating the principle of the curvature comparison method which is processing performed by the heating point determining unit 41 in FIG. 11 (a comparison between the target shape and the measured shape when approximated by fold lines defined by the bases of a plurality of isosceles triangles)

FIGS. 22 to 24 are explanation drawings for illustrating another example of processing performed by the heating point determining unit 41. The processing shown in these drawings focuses on the fact that the curved shape of the steel plate 2 on a predetermined line, such as each frame line, can be regarded as a collection of arcs with a plurality of curvatures. The arc of the target shape is compared with the arc of an actually measured shape corresponding to this arc portion on the basis of the curvatures of both arcs. Based on the results of comparison, the heating point is determined. This method is called "the curvature comparison method".

FIGS. 22 and 23 are views for illustrating the principle of the curvature comparison method. FIG. 22 shows the curve of the target shape (only its half to the right of M line, the reference line, is shown) divided into fine segments $D_1$ to $D_n$ which are arcs with radii of $R_1$ to $R_n$. Whereas FIG. 23 shows a mode in which one of the divisional arcs indicated in FIG. 22 is approximated by a fold line defined by the bases of a plurality of (number m in FIG. 23) congruent isosceles triangles connected together while sharing their equal sides. As shown in FIG. 22, the target shape is divided into a plurality of fine segments $D_1$ to $D_n$, these fine segments $D_1$ to $D_n$ are regarded as arcs, curvatures or radii are designated for the respective segments $D_1$ to $D_n$, and the lengths $l_1$ to $l_n$ of the arcs of the respective segments $D_1$ to $D_n$ are designated, whereby the target shape can be specified. Thus, if the target shape data in the respective segments $D_1$ to $D_n$ are compared with the steel plate measurement data, the amount of deformation of the steel plate 2 for making the target shape and the shape of the steel plate agree can be determined by the difference between the two types of data. Here, the deformation in heat bending is bending at the heating points. That is, the arcs in the respective fine segments are approximated by straight lines.

As shown in FIG. 23, when an arc within radius R is approximated by the fold line defined by the bases of the m number of the isosceles triangles connected together while sharing their equal sides, the length l of the arc is generally given by the equation (1):

$$L=2\theta\cdot R\cdot m \tag{1}$$

In the equation (1), θ is the angle between the bases of the isosceles triangles.

FIG. 24 is an explanation drawing which shows by a two-dot chain line a mode in which the arc of one segment of the target shape is approximated by a fold line $N_O$ defined by the bases of the m number of isosceles triangles connected together while sharing their equal sides, and which shows by a solid line a mode in which the arc of one segment of the measured shape corresponding to this segment is approximated by a fold line $N_C$ defined by the bases of the m number of isosceles triangles connected together while sharing their equal sides. As shown in FIG. 24, straight lines connecting the points ($P_{O1}$, $P_{O2}$), ($P_{O2}$, $P_{O3}$), ($P_{O3}$, $P_{O4}$) . . . make the fold line $N_O$, while straight lines connecting the points ($P_{C1}$, $P_{C2}$), ($P_{C2}$, $P_{C3}$), ($P_{C3}$, $P_{C4}$) . . . make the fold line $N_C$. $\theta_O$ is the angle that each subline of the fold line $N_O$ forms with the adjacent subline, while $\theta_C$ is the angle that each subline of the fold line $N_C$ forms with the adjacent subline. Referring to FIG. 24, one will see that when each subline of the fold line based on the measured shape indicated by the solid line is bent by $\Delta\theta$ ($=\theta_O-\theta_C$), it coincides with each subline of the fold line based on the target shape.

Let the length of the segment of the target shape and the measured shape of the steel plate 2 to be compared be $l_0$, and the radius of the arc of the target shape in this segment be $R_0$. When this arc is approximated by the fold line $N_O$ defined by the bases of the m number of isosceles triangles connected together while sharing their equal sides, the relation of the equation (2) is obtained from the equation (1):

$$l_0=2\theta_O\cdot R_0\cdot m \tag{2}$$

On the other hand, let the radius of the arc based on the measured shape of the portion corresponding to the segment to be compared be $R_C$. When this arc is approximated by the fold line $N_C$ defined by the bases of the m number of isosceles triangles connected together while sharing their equal sides, the relation of the equation (3) is obtained from the equation (1):

$$l_C=2\theta_C\cdot R_C\cdot m \tag{3}$$

To heat-process the measured shape into the target shape, it is necessary to bend the m number of sublines of the fold line $N_C$ for the measured shape in the manner stated earlier. When the bending angle at this time is designated as $\Delta\theta$, the bending angle $\Delta\theta$ is given as the difference between the angle formed by the adjacent sublines of the fold line $N_C$ and the angle formed by the adjacent sublines of the fold line $N_O$. That is, the bending angle $\Delta\theta$ is expressed by the equation (4):

$$\begin{aligned}\Delta\theta = \theta_o - \theta_c &= (l_o / 2R_o \cdot m) - (l_o / 2R_c \cdot m) \\ &= \{l_o(R_c - R_o)\} / (2 \cdot R_o \cdot R_c \cdot m)\end{aligned} \tag{4}$$

Here, the lengths of the fold lines tobe compared are equal, so that $l_0=l_C$.

In heating of a single steel plate 2, its efficiency is high when the amount of heating (e.g., the amount of heat input based on parameters such as an electric current, and the clearance between a high frequency heating coil and the steel plate 2, during high frequency heating) is made constant overall. When the amount of heating is constant, the bending angle $\Delta\theta$ is derived from the properties (material, thickness, etc.) of the steel plate 2. That is, a predetermined bending angle $\Delta\theta$ is determined by determining the desired amount of heating, and the number m of the sublines of each of the fold lines $N_O$ and $N_C$ is given by the equation (5):

$$m=\{l_0(R_C-R_0)\}/(2\cdot R_0\cdot R_C\cdot\Delta\theta) \tag{5}$$

This means that if the bending angle $\Delta\theta$ is given, it suffices to divide the length $l_C$ by the number m calculated from the equation (5). In other words, the heating points are obtained as respective positions found when the length $l_C$ is divided by the heating distance ($l_C$/m) That is, if the radius $R_0$ of the arc of the target shape, the radius $R_C$ of the arc of the measured shape corresponding thereto, the length $l_0$ (length of the segment to be compared) of both arcs, and the bending angle $\Delta\theta$ are given, then the three-dimensional positional coordinates of the corresponding heating points can be sought as solutions to geometrical problems by computations.

In case the steel plate 2 is a flat plate, on the other hand, the radius $R_C$ in the equation (5) becomes infinity, so that m cannot be obtained. Thus, the equation (5) is converted into the equation (6):

$$\begin{aligned}m &= \{l_o(R_c - R_o)\} / (2 \cdot R_o \cdot R_c \cdot \Delta\theta) \\ &= \{l_o(1 - R_o / R_c)\} / (2 \cdot R_o \cdot \Delta\theta)\end{aligned} \tag{6}$$

Infinitizing $R_C$ in the equation (6) makes ($R_0/R_C$) zero, thus giving the equation (7):

$$m=l_0/(2\cdot R_0\cdot\Delta\theta) \tag{7}$$

The equation (7) is equal to calculating the number m of isosceles triangles for the length $l_0$ of the arc in the isosceles triangles which inscribe in the target shape with radius $R_0$ and whose adjacent bases form the angle $\Delta\theta$. In short, when a flat plate is bent, the heating distance can be found from the radius $R_0$ of the target shape and the bending angle $\Delta\theta$.

To determine the heating points by the above-described curvature comparison method, the heating point determining unit 41 prepares the following data on the basis of the target shape data read in: ① position data on the reference line on each frame line, ② position data on the end of the steel plate 2 as the object to be processed, ③ curvature data on the arc in each segment when the curved shape of the steel plate 2 on each frame line is regarded as a collection of arcs with a plurality of curvatures, and ④ position data on the point of the boundary between each segment and the adjacent segment. The curvature data ③ are values designated at the time of designing, or if these values are not designated, the data are calculated using the point sequence data of the target shape data. Similarly, data corresponding to ① to ④ are compiled from the steel plate shape measurement data as well. At this time, the data ③ correspond to the respective segments of the target shape.

The heating point determining unit 41 processes the data ① to ④ on the target shape and the measured shape, and calculates the heating points by the curvature comparison method described based on FIGS. 22 to 24. An example of the relevant concrete procedure will be explained by reference to FIGS. 25 to 28. FIGS. 25 to 28 are flow charts showing this example. In this example, the heating points are obtained on the frame lines, but needless to say, the way of obtaining them is not restricted to this manner. However, the frame lines are lines corresponding to the positions at which frame materials are attached. Thus, data on their positions are stored as design data. The use of the frame lines in obtaining the heating points is advantageous in the applicability of such data.

Figure 25:
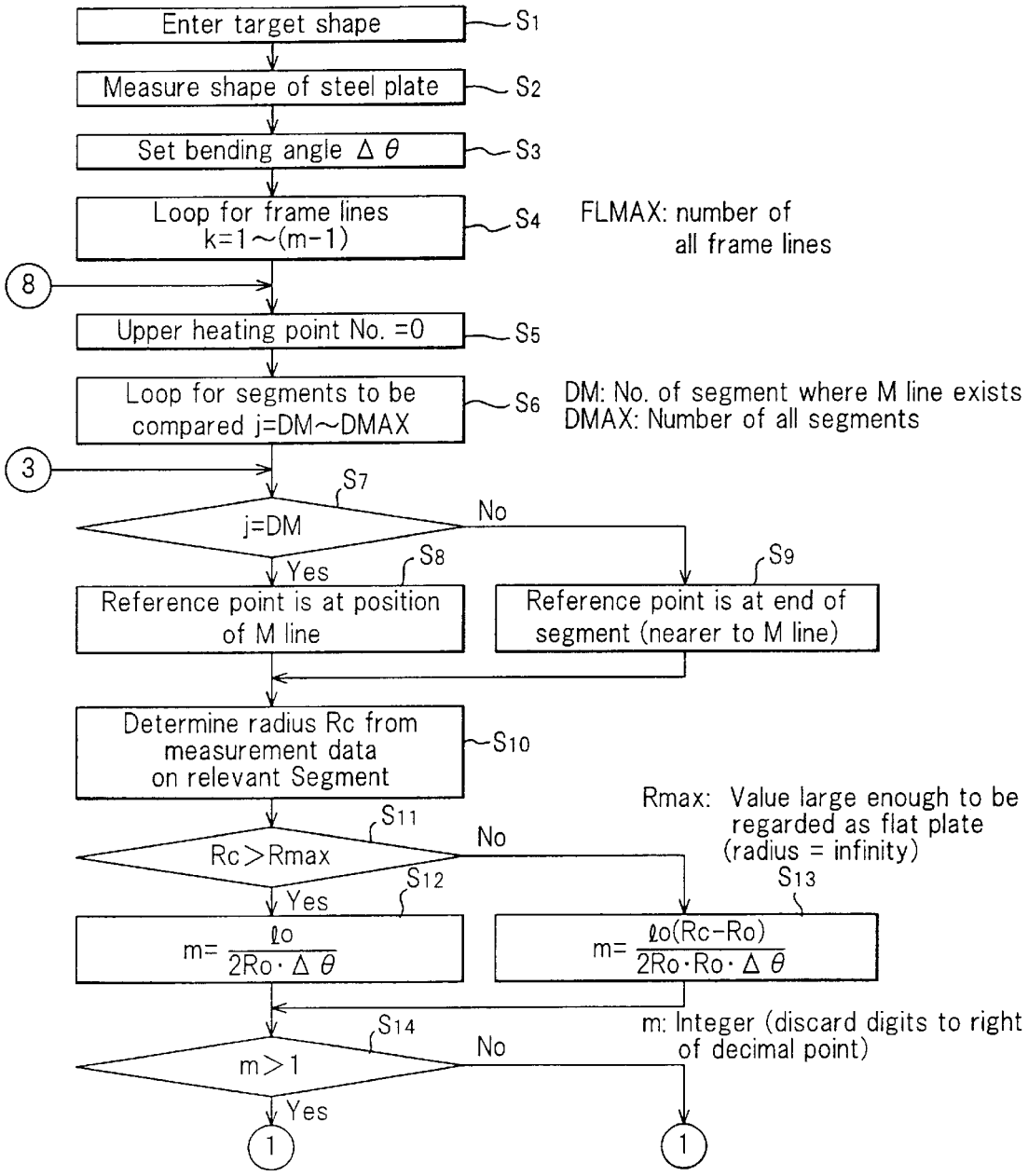
FIG. 25 is a flow chart 1 showing a further example for determination of heating points.

As shown in FIG. 25, the following processings are performed:

1) Design data such as CAD data are loaded to enter the target shape of the steel plate as three-dimensional data, and processings are also performed for the preparation of the data ① to ④, such as curvature data on the arc in each segment constituting each frame line, and position data on the point of the boundary between each segment and the adjacent segment (step $S_1$).

2) The shape of the steel plate 2, the object to be processed, is measured to obtain three-dimensional coordinate data thereon, and processings are also performed for the preparation of the data ① to ④ as for the target shape (step $S_2$).

Measurement of the shape of the steel plate 2 can be easily performed by an existing measuring method, such as laser measurement or image processing of an image shot with a camera.

3) The bending angle $\Delta\theta$, a heat deforming angle, is set (step $S_3$).

4) The processings at step $S_5$ through step $S_{41}$ are performed for the respective frame lines (step $S_4$). The expression "Loop . . . " indicated in the block for step $S_4$ refers to an operation in which the processings at steps subsequent to the step at issue (in this case, step $S_4$) are regarded as one loop, and the processings belonging to this loop are sequentially repeated for each frame line, as in the instant embodiment (the same will hold later on). At step $S_4$, the frame line No. i is designated as "1", and the flow moves to the processing at anext step $S_5$. "FLMAX" means the maximum frame line No. (the same will hold later on).

5) Since no upper heating point exists initially, "0" is set as the initial value of the heating point No. (step $S_5$). "The upper heating point" means the heating point above a reference line, a straight line heading in the direction of a central axis of a cylinder whose part is deemed to approximate the target shape of the steel plate 2 (e.g., a point above the roller reference line 16' used in the explanation of a heating line determination method to be detailed later based on FIG. 14) when it is determined whether the heating point is above or below the reference line. For example, the heating point with a larger Y coordinate than that of a point on the reference line is regarded as the upper heating point.

6) The processings at step $S_7$ to step $S_{22}$ are performed for the respective segments, DM to DMAX, to be compared (step $S_6$). "DM" denotes the No. of the segment where the M line, the initial reference position, exists. "DMAX" designates the maximum value of the segment No.

7) It is judged whether the segment is the segment where the M line, the initial reference position, exists (step $S_7$).

8) If the processing at step $S_7$ shows it to be the segment where the M line exists, a judgment is made that the reference point is at the position of the M line. Based on this judgment, this position is set (step $S_8$).

9) If the processing at step $S_7$ shows it to be the segment where no M line exists, a judgment is made that the reference point is at the end of the segment nearer to the M line. Based on this judgment, this position is set (step $S_9$).

10) The radius $R_C$ is found from the measurement data on the relevant segment (step $S_{10}$).

11) It is judged whether $R_C$ is larger than the radius $R_{max}$ (step $S_{11}$). The radius $R_{max}$ has been set at a value large enough for the steel plate to be regarded as a flat plate (radius=infinity).

12) If the processing at step $S_{11}$ shows $R_C > R_{max}$, the steel plate 2 as the object to be processed is deemed to be a flat plate. Thus, a calculation based on the equation (8) is done to determine the number m of the sublines of a fold line belonging to the relevant segment (step $S_{12}$).

13) If the processing at step $S_{11}$ shows $R_C \leqq R_{max}$, a calculation based on the equation (7) is made to determine the number m of the sublines of a fold line belonging to the relevant segment (step $S_{13}$). The value of m is treated such that the digits to the right of the decimal point are discarded to give an integer.

14) It is judged whether the number m of the sublines is larger than 1 (step $S_{14}$).

Figure 26:
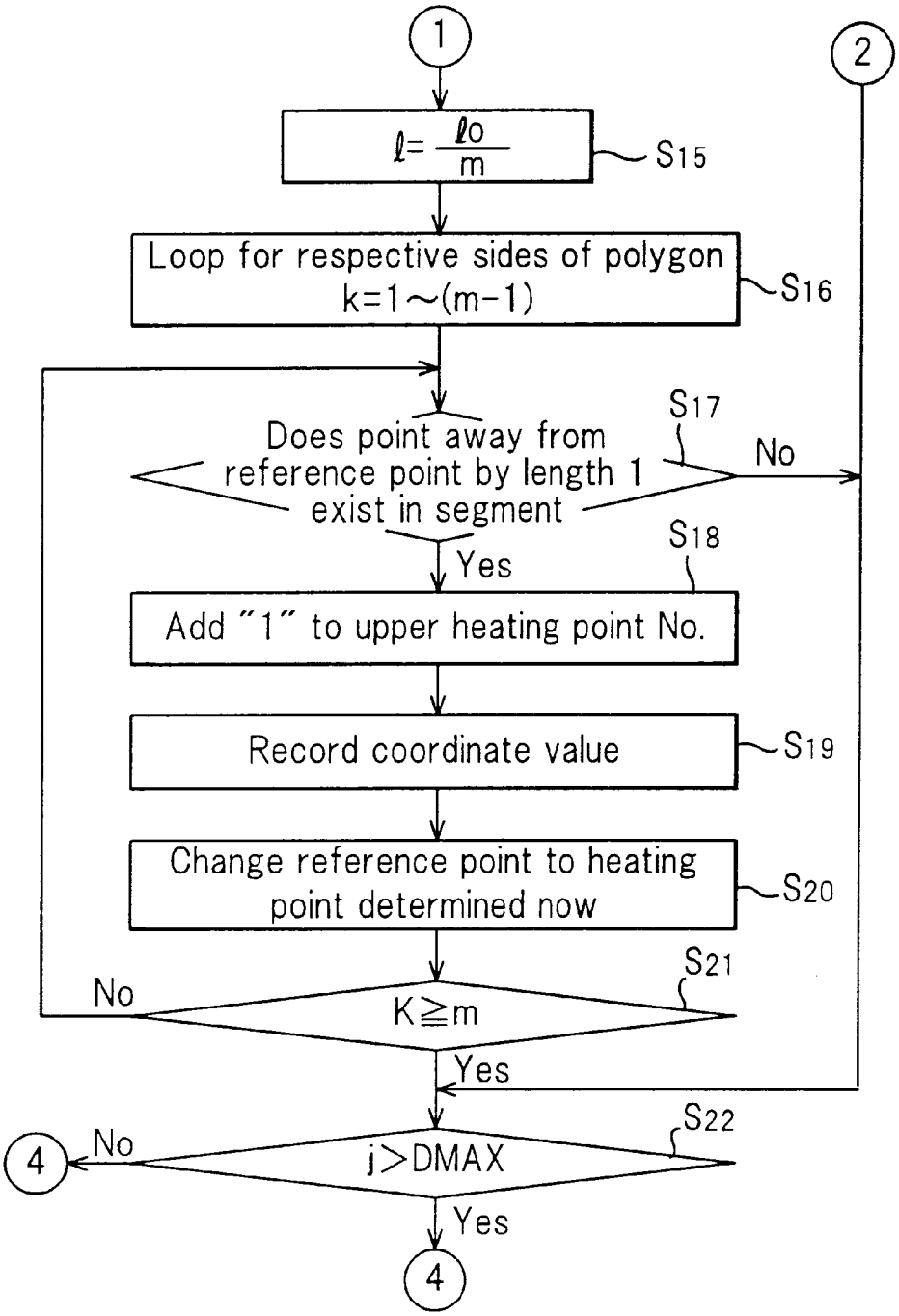
FIG. 26 is a flow chart 2 showing the further example for determination of heating points.

As shown in FIG. 26, the following processings are performed:

15) If the processing at step $S_{14}$ shows m>1, the length l of the heating distance ($l=l_0/m$) is calculated (step $S_{15}$). If $m \leqq 1$, this means that two or more sublines are not present in the relevant segment, and there is no apex which should serve as the position of bending. Thus, the procedure moves to the processing for a next segment.

16) The processings at steps $S_{17}$ through $S_{21}$ are performed for the respective sublines of the fold line belonging to the relevant segment (step $S_{16}$).

17) It is judged whether a point apart from the reference point in the relevant segment by the length l of the heating distance exists in this segment (step $S_{17}$).

18) If the processing at step $S_{17}$ shows the existence of such a point in the segment, "1" is added to the upper heating point No. (step $S_{18}$). If that processing shows the absence of such a point, the flow moves to the processing for a next segment.

19) In addition to the upper heating point No. associated with the processing at step $S_{18}$, the coordinate value of this heating point is recorded (step $S_{19}$).

20) The reference point is changed to the heating point determined at step $S_{19}$ (step $S_{20}$).

21) The processings at steps $S_{17}$ through $S_{20}$ are repeated until the No. of the subline belonging to the segment becomes $k \geqq m$ (step $S_{21}$). Each time the flow returns from step $S_{21}$ to the processing at step $S_{17}$, "1" is added to the subline No. k.

22) If the processing at step $S_{21}$ shows $k \geqq m$, if the processing at step $S_{17}$ shows the absence of a predetermined point in the segment, or if the processing at step $S_{14}$ shows $m \leqq 1$, the processings at steps $S_7$ through $S_{21}$ are repeated until the segment No. becomes j>DMAX (step $S_{22}$). Each time the flow returns from step $S_{22}$ to the processing at step $S_7$, "1" is added to the segment No. j.

Figure 27:
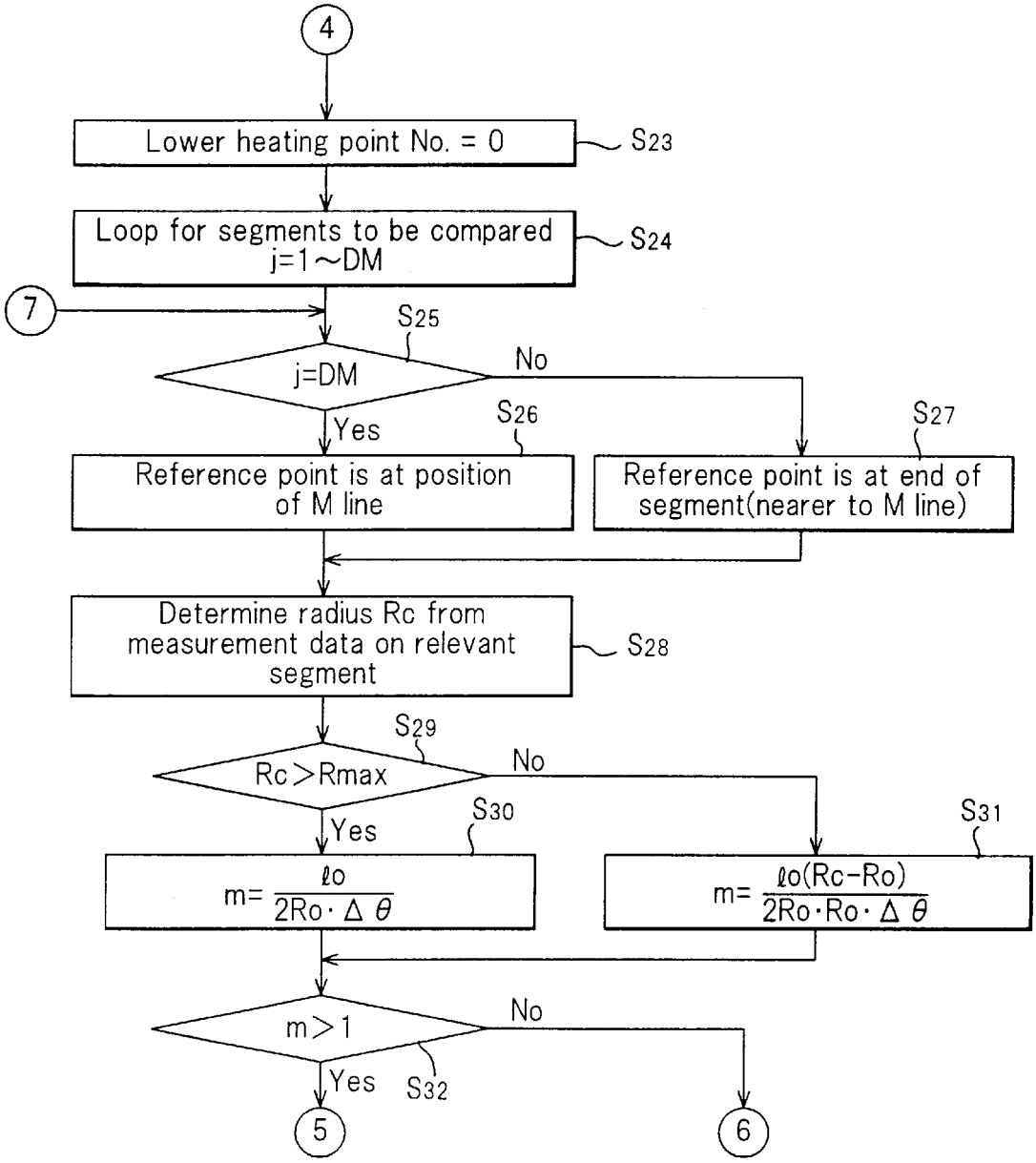
FIG. 27 is a flow chart 3 showing the further example for determination of heating points.
Figure 28:
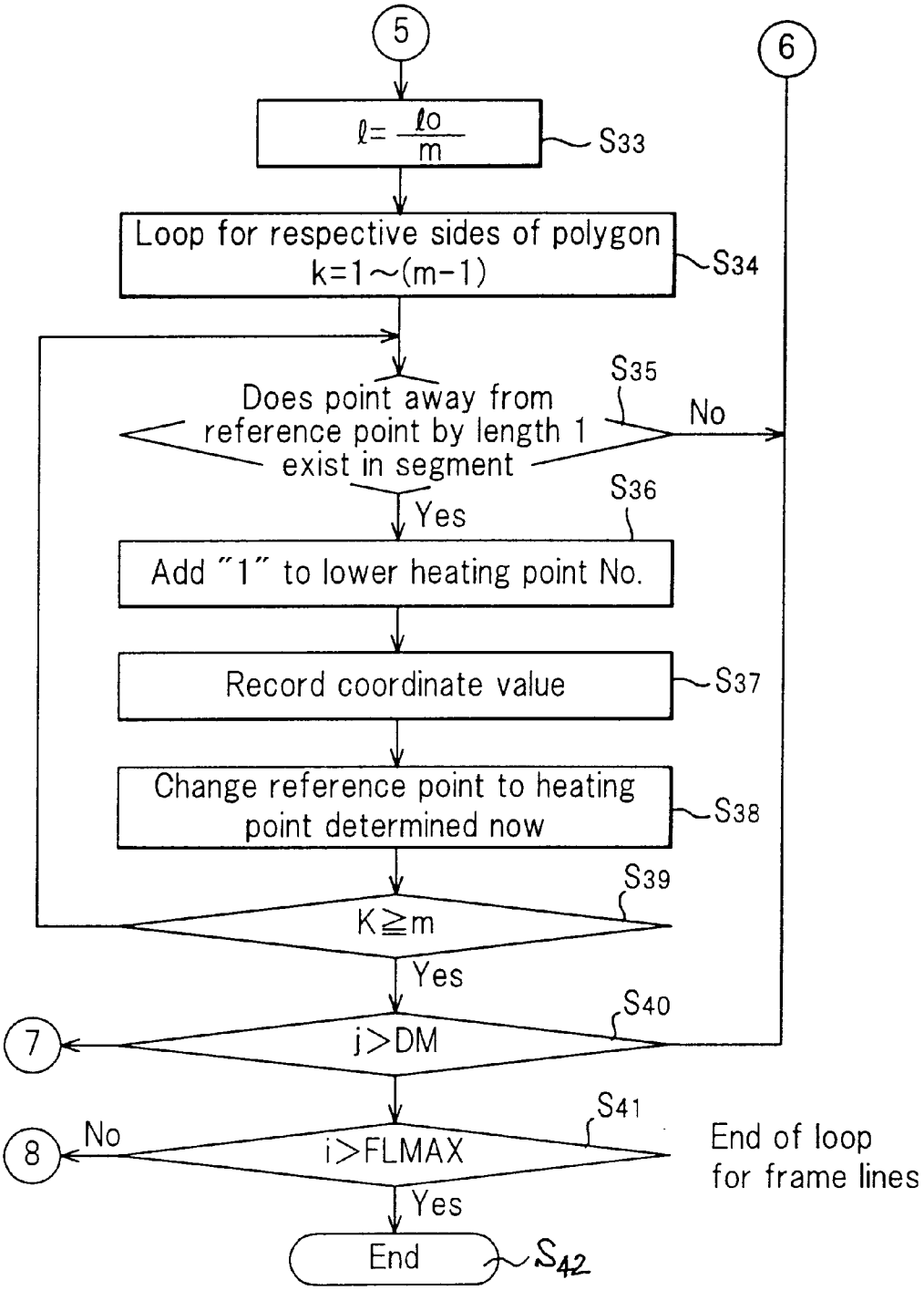
FIG. 28 is a flow chart 4 showing the further example for determination of heating points.
Figure 29A:
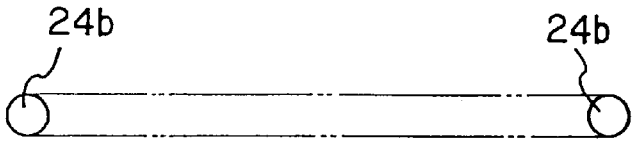
FIGS. 29(*a*) to 29(*d*) are explanation drawings conceptually showing examples of the forms of heating using the coil portion 24*b* of the automatic plate bending system concerned with the instant embodiment.
Figure 29B:
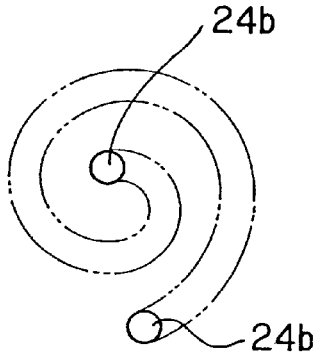
Figure 29C:
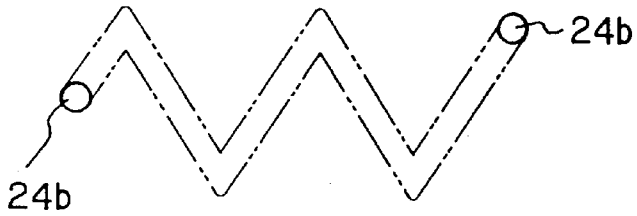
Figure 29D:
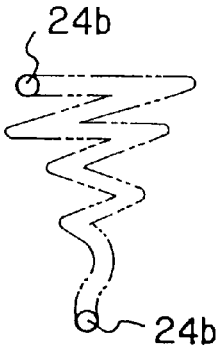

As shown in FIGS. 27 and 28, the following processings are performed:

23) The same processings as those at steps $S_5$ to $S_{40}$ are performed for the lower heating points (steps $S_{23}$ to $S_{40}$).

24) If the processing at step $S_{40}$ shows j>DM, this means that the upper and lower heating points have been determined for a certain frame line. Thus, the flow returns to the processing at step $S_5$, and the processings at steps $S_5$ through $S_{40}$ are repeated until i>FLMAX (step $S_{41}$). Each time the flow returns from step $S_{41}$ to the processing at step $S_5$, "1" is added to the frame line No. i. When i>FLMAX, all the processings are completed (step $S_{42}$).

A concrete procedure using the heating line determining unit 44 for determining the heating lines based on the heating points that have been determined by the curvature comparison method is the same as that described in the flow charts for the aforementioned embodiment (FIGS. 17 to 19). That is, the three-dimensional data on the heating points on the respective frame lines obtained at step $S_{19}$ of FIG. 26 and step $S_{37}$ of FIG. 28 are entered for "Enter sequence of heating points" at step $S_{21}$ of FIG. 17.

The automatic plate bending system concerned with the instant embodiment has the coil portion 24*b* (see FIG. 8) whose portion generating a magnetic flux for induction heating the steel plate 2 is shaped like a circle with a diameter nearly equal to the diameter of a flame of a gas burner used when heating the steel plate 2. Thus, the automatic plate bending system can perform various forms of heating, including line heating along the heating line 3.

FIGS. 29(*a*) to 29(*d*) show forms of heating of the steel plate 2 using the coil portion 24*b* concerned with the above-described embodiment. In these drawings, the locus of movement of the coil portion 24*b* is indicateel by a two-dot chain line. FIG. 29(*a*) represents line heating. The line heating over an arbitrary length can be performed by linearly moving the coil portion 24*b*. FIG. 29(*b*) represents spot heating. In the case of spot heating, the coil portion 24*b* is moved spirally, whereby heating can be performed in a circular shape with an arbitrary radius. FIG. 28 (*c*) represents weaving heating. With the weaving heating, the coil portion 24*b* is moved in a zigzag form, whereby a wavy shape within arbitrary width can be heated. FIG. 29(*d*) represents pine needle heating. With the pine needle heating, an arbitrary triangular shape can be heated by moving the coil portion 24*b* while continuously varying its zigzag width.

With induction heating using the coil portion 24*b*, it is vital, as stated earlier, that the clearance between the coil portion 24*b* and the steel plate 2, the member to be heated, be kept constant. To secure a constant clearance between the coil portion 24*b* and the steel plate 2, the high frequency heating head 24 is provided with the steel ball portions 24*c* in the aforementioned embodiment. Means of securing the clearance is not restricted to them. A constant clearance can be secured by utilizing a magnetic force or a reaction force by a high pressure gas.

Figure 30:
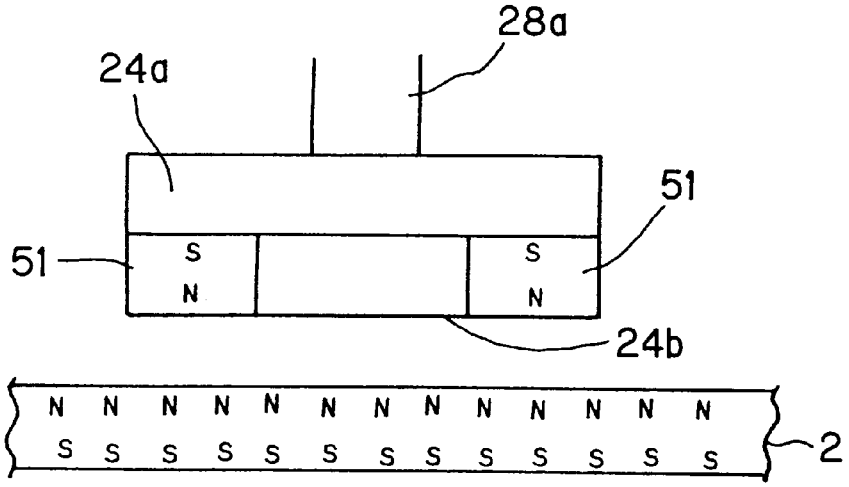
FIG. 30 is an explanation drawing conceptually showing a first modified example of a structure for retaining clearance with which the coil portion 24*b* is mounted.

FIG. 30 is an explanation drawing conceptually showing a first modified example of a structure for retaining clearance with which the coil portion 24*b* is mounted. As shown in FIG. 30, the mounting clearance retaining structure according to this example has a magnet 51 disposed on an outer peripheral part of the coil portion 24*b* so as to surround the coil portion 24*b*. The magnet 51 is secured to the disk portion 24*a*. The steel plate 2, the member to be heated, is magnetized such that its surface opposed to the magnet 51 is of the same polarity as the polarity of a surface of the magnet 51 facing the steel plate 2. Thus, the coil portion 24*b* levitates under a magnetic repulsive force working between the magnet 51 and the magnetized surface of the steel plate 2, thereby keeping the clearance between the coil portion 24*b* and the steel plate 2 constant.

Figure 31:
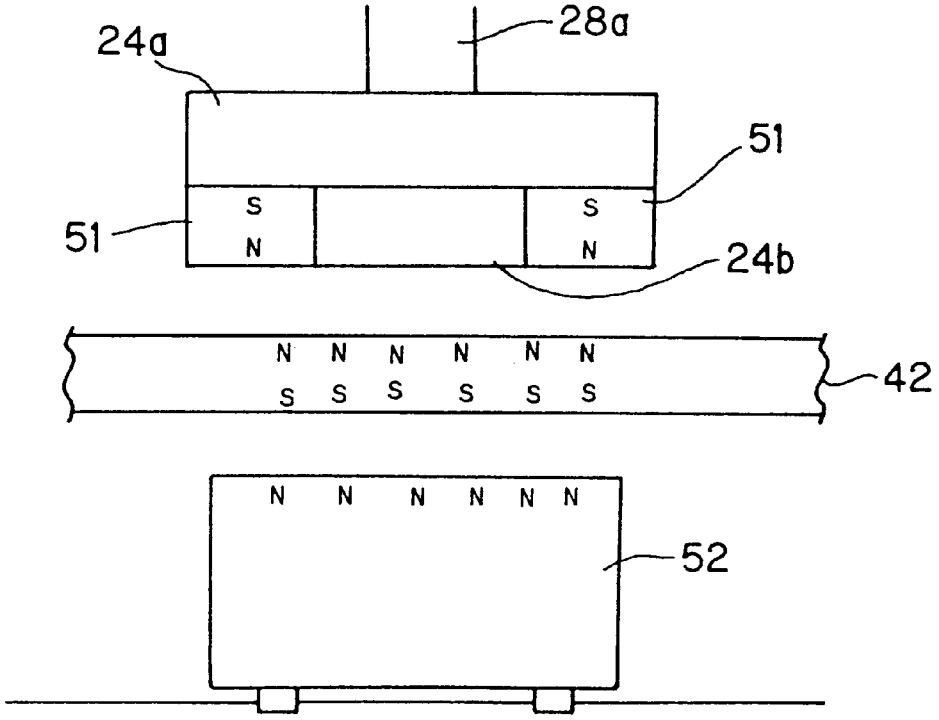
FIG. 31 is an explanation drawing conceptually showing a second modified example of a structure for retaining clearance with which the coil portion 24*b* is mounted.

FIG. 31 is an explanation drawing conceptually showing a second modified example of a structure for retaining clearance with which the coil portion 24*b* is mounted. As shown in FIG. 31, the mounting clearance retaining structure according to this example differs from the first modified example shown in FIG. 30 in that a magnetic force source 52 is disposed below the steel plate 42. This magnetic force source 52 magnetizes the steel plate 42 such that the surface of the steel plate 42 opposed to the magnet 51 is of the same polarity as the polarity of the opposed surface of the magnet 51. Thus, the coil portion 24*b* levitates under a magnetic repulsive force working between the magnet 51 and the magnetized surface of the steel plate 42, as in the first modified example, whereby the clearance between the coil portion 24*b* and the steel plate 42 is kept constant. In order for the portion of the steel plate 42 opposed to the magnet 51 to be magnetized always satisfactorily, the magnetic force source 52 is adapted to move synchronously with the movement of the coil portion 24*b* so as to be located below the magnet 51 as the coil portion 24*b* moves.

Figure 32:
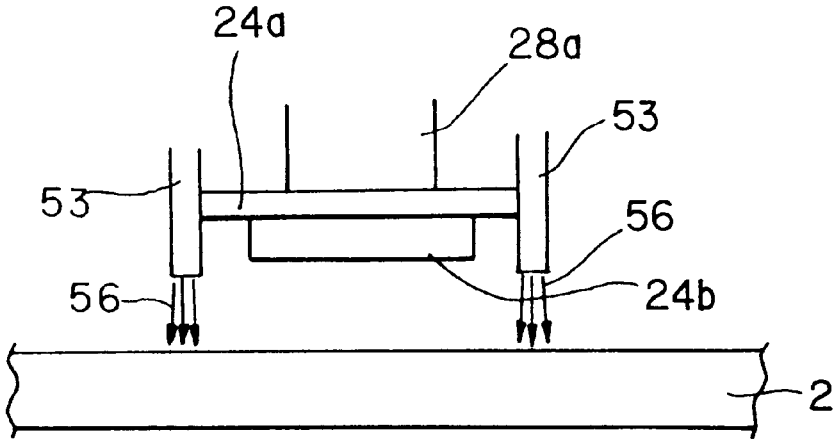
FIG. 32 is an explanation drawing conceptually showing a third modified example of a structure for retaining clearance with which the coil portion 24*b* is mounted.

FIG. 32 is an explanation drawing conceptually showing a third modified example of a structure for retaining clearance with which the coil portion 24*b* is mounted. As shown in FIG. 32, the mounting clearance retaining structure according to this example has a plurality of nozzles 53 disposed around the coil portion 24*b*, and jets high pressure air 56 vertically downwardly through the nozzles 53 toward the surface of the steel plate 2. By this measure, the coil portion 24*b* is levitated under a reaction force by jets of the high pressure air 56, whereby the clearance between the coil portion 24*b* and the steel plate 2 is kept constant. The nozzles 53 are secured to the disk portion 24*a*.

Figure 33:
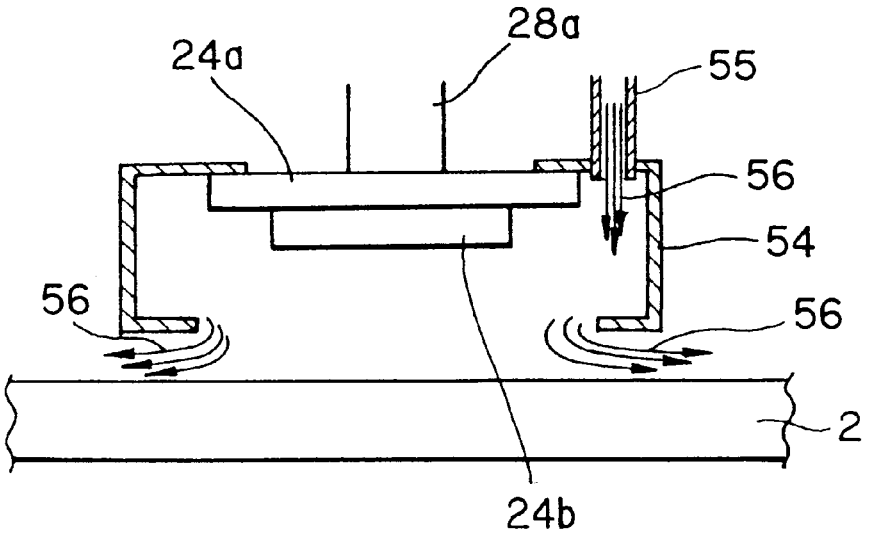
FIG. 33 is an explanation drawing conceptually showing a fourth modified example of a structure for retaining clearance with which the coil portion 24*b* is mounted.

FIG. 33 is an explanation drawing conceptually showing a fourth modified example of a structure for retaining clearance with which the coil portion 24*b* is mounted. As shown in FIG. 33, the mounting clearance retaining structure according to this example covers the coil portion 24*b* with a cover 54. The cover 54 has an opening which opens downwardly, and has its upper part secured to the disk portion 24*a*. The cover 54 has a pipe 55 which is attached thereto while piercing through a part of the upper surface of the cover 54, and high pressure air 56 is supplied into the cover 54 through the pipe 55. Also, the high pressure air 56 supplied into the cover 54 is jetted toward the surface of the steel plate 2 opposed to the aforementioned opening. Thus, the coil portion 24*b* is levitated under a reaction force generated by jets of the high pressure air 56, whereby the clearance between the coil portion 24*b* and the steel plate 2 is kept constant.

In the first and second modified examples of the foregoing modified examples, the magnet 51 may be a permanent magnet or an electromagnet. In view of the controllability that the magnetic force can be varied arbitrarily by an electric current, the electromagnet is preferred. In the first to fourth modified examples, the position of the coil portion 24*b* is measured with a sensor, although this is not shown. Control is performed such that the position of the coil portion 24*b* relative to the steel plate 2 is detected on the basis of positional information obtained by the measurement, whereupon the clearance between the coil portion 24*b* and the steel plate 2 will become constant. This control can be achieved by feedback controlling the magnetic force of the magnet 51 or the steel plate 2 in the first modified example, or the magnetic force of the magnet 51 or magnetic force source 52 in the second modified example, on the basis of the positional information. In the third and fourth modified examples, on the other hand, the control can be achieved by feedback controlling the amount or pressure of jets of the high pressure air 56 on the basis of the positional information.

What is claimed is:

1. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system.

2. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system.

3. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing steel balls around the high frequency heating coil, and bringing the steel balls into contact with the surface of the member to be heated.

4. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing steel balls around the high frequency heating coil, and bringing the steel balls into contact with the surface of the member to be heated.

5. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a magnet around the high frequency heating coil, and causing a magnetic force to work between the magnet and the member to be heated.

6. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a magnet around the which frequency heating coil, and causing a magnetic force to work between the magnet and the member to be heated.

7. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force.

8. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heation coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force.

9. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

said high frequency heating coil having a circular shape whose diameter nearly equals the diameter of a flame of a gas burner to be used when heating the same member to be heated.

10. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heation coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequesncy heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

said high frequency heating coil having a circular shape whose diameter nearly equals the diameter of a flame of a gas burner to be used when heating the same member to be heated.

11. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing steel balls around the high frequency heating coil, and bringing the steel balls into contact with the surface of the member to be heated; and said high frequency heating coil further having a circular shape whose diameter nearly equals the diameter of a flame of a gas burner to be used when heating the same member to be heated.

12. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing steel balls around the high frequency heating coil, and bringing the steel balls into contact with the surface of the member to be heated; and said high frequency heating coil further having a circular shape whose diameter nearly equals the diameter of a flame of a gas burner to be used when heating the same member to be heated.

13. An automatic plate bending system losing high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a magnet around the high frequency heating coil, and causing a magnetic force to work between the magnet and the member to be heated; and said high frequency heating coil further having a circular shape whose diameter nearly equals the diameter of a flame of a gas burner to be used when heating the same member to be heated.

14. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a magnet around the high frequency heating coil, and causing a magnetic force to work between the magnet and the member to be heated; and said high frequency heating coil further having a circular shape whose diameter nearly equals the diameter of a flame of a gas burner to be used when heating the same member to be heated.

15. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force; and said high frequency heating coil further having a circular shape whose diameter nearly equals the diameter of a flame of a gas burner to be used when heating the same member to be heated.

16. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, end also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force; and said high frequency heating coil further having a circular shape whose diameter nearly equals the diameter of a flame of a gas burner to be used when heating the same member to be heated.

17. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

18. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said which frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

19. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing steel balls around the high frequency heating coil, and bringing the steel balls into contact with the surface of the member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

20. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing steel balls around the high frequency heating coil, and bringing the steel balls into contact with the surface of the member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

21. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a magnet around the high frequency heating coil, and causing a magnetic force to work between the magnet and the member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

22. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heation coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a magnet around the high frequency heating coil, and causing a magnetic force to work between the magnet and the member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

23. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

24. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

25. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

26. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

27. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing steel balls around the high frequency heating coil, and bringing the steel balls into contact with the surface of the member to be heated;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

28. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, Elo as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing steel balls around the high frequency heating coil, and bringing the steel balls into contact with the surface of the member to be heated;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

29. An automatic plate bending system using high frequency induction heating, comprising:

a travel system free to travel in a horizontal plane, said travel system having a longitudinally traveling trolley stretching over two parallel rails are traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a magnet around the which frequency heating coil, and causing a magnetic force to work between the magnet and the member to be heated;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

30. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a magnet around the high frequency heating coil, and causing a magnetic force to work between the magnet and the member to be heated;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

31. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data on the member to be heated, a heating operation is stopped.

32. An automatic plate bending system using high frequency induction heating, comprising:

a travel system free to travel in a horizontal plane, said travel system having a longitudinally traveling trolley stretching over two parallel rails and traveling along these rails, and a transversely traveling trolley traveling on the longitudinally traveling trolley in a direction perpendicular to the direction of the rails;

a high frequency heating coil for induction heating the surface of a member to be heated, said high frequency heating coil being attached to the transversely traveling trolley so as to be vertically movable, and being opposed, with a constant clearance, to the surface of the member to be heated;

a shape measuring unit attached to the transversely traveling trolley, for measuring the shape of the surface of the member to be heated;

universal poles disposed vertically at a multiplicity of specified positions between the rails, with the height positions of front end portions of the universal poles themselves being adjustable, so as to bear the member to be heated, by supporting the member from below; and a control unit for controlling the travel of the travel system in the horizontal plane on the basis of predetermined heating line data so that the high frequency heating coil heats the member to be heated, along predetermined heating lines via the travel system, and also controlling the travel of the travel system in the horizontal plane on the basis of predetermined measurement data so that the shape measuring unit moves along a predetermined measuring path via the travel system;

the clearance between the high frequency heating coil and the surface of the member to be heated being secured by providing a high pressure gas jetting unit near the high frequency heating coil, and directing a high pressure gas jetted by the high pressure gas jetting unit toward the surface of the member to be heated, thereby generating a reaction force;

said high frequency heating coil having a circular shape whose diameter nearly equals the diameter of a flame of a gas burner to be used when heating the same member to be heated; and said control unit further performing control such that as the member to be heated is bent, each of the universal poles moves in response to changes in the shape of the member to be heated, and such that when any of the universal poles after responsive movement reaches a target front end position for each universal pole that has been determined on the basis of target shape data an the member to be heated, a heating operation is stopped.

33. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line ori the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

point; then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points; and calculates the three-dimensional coordinates of a heating point on the basis of a point of intersection of the first and second straight lines.

34. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines; and based on an angle of intersection of the first and second straight lines, calculates a bending angle for the steel plate at the heating point.

35. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and, a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straights lines; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate.

36. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines;

based on an angle of intersection of the first and second straight lines, calculates a bending angle for the steel plate at the heating point; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate.

37. The automatic plate banding system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points calculated by the heating point determining unit;

draws straight lines from a certain heating point on a certain line, as a starting point, to heating points on other lines on the basis of data on the respective heating points;

examines the degree of parallelism between each of the straight lines and a roller line involved during primary bending of the steel plate;

if the degree of parallelism is within a predetermined range, performs grouping of the relevant heating points as the heating points of the same group; and connects the respective heating points of the same group by a straight line or a curve to determine a heating line.

38. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines;

based on an angle of intersection of the first and second straight lines, calculates a bending angle for the steel plate at the heating point; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points calculated by the heating point determining unit;

draws straight lines from a certain heating point on a certain line, as a starting point, to heating points on other lines on the basis of data on the respective heating points;

examines the degree of parallelism between each of the straight lines and a roller line involved during primary bending of the steel plate;

if the degree of parallelism is within a predetermined range, performs grouping of the relevant heating points as the heating points of the same group; and connects the respective heating points of the same group by a straight line or a curve to determine a heating line.

39. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points and bending angles calculated by the heating point determining unit;

draws straight lines from a certain heating point on a certain line, as a starting point, to heating points on other lines on the basis of data on the respective heating points;

examines the degree of parallelism between each of the straight lines and a roller line involved during primary bending of the steel plate;

if this degree of parallelism is within a predetermined range, performs grouping of the relevant heating points as the heating points of the same group;

connects the respective heating points of the same group by a straight line or a curve to determine a heating line; and calculates the amounts of heating at the respective heating points on the basis of the data on the bending angles of the steel plate at the respective heating points.

40. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the references position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines;

based on an angle of intersection of the first and second straight lines, calculates a bending angle for the steel plate at the heating point; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points and bending angles calculated by the heating point determining unit;

draws straight lines from a certain heating point on a certain line, as a starting point, to heating points on other lines on the basis of data on the respective heating points;

examines the degree of parallelism between each of the straight lines and a roller line involved during primary bending of the steel plate;

if this degree of parallelism is within a predetermined range, performs grouping of the relevant heating points as the heating points of the same group;

connects the respective heating points of the same group by a straight line or a curve to determine a heating line; and calculates the amounts of heating at the respective heating points on the basis of the data on the bending angles of the steel plate at the respective heating points.

41. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points on the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines;

after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points and bending angles calculated by the heating point determining unit;

draws straight lines from a certain heating point on a certain line, as a starting point, to heating points on other lines on the basis of data on the respective heating points and bending angles;

examines the degree of parallelism between each of the straight lines and a roller line involved during primary bending of the steel plate;

if this degree of parallelism is within a predetermined range, and if the amounts of heating at the heating points determined by the bending angles of the steel plate at the respective heating points are equal to each other, performs grouping of the relevant heating points as the heating points of the same group; and connects the respective heating points of the same group by a straight line or a curve to determine a heating line.

42. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

places a virtual wooden pattern formed from the target shape data on a virtual steel plate formed from the steel plate shape measurement data;

rolls the wooden pattern or steel plate along a specific line on the steel plate from a predetermined reference position in a plane including a cross section of the steel plate, to bring the wooden pattern and the steel plate into contact at two points, with the contact points are the steel plate being designated as a first contact point and a second contact point, and the contact points on the wooden pattern being designated as a third contact point and a fourth contact point;

then rolls the wooden pattern or the steel plate in the reverse direction to return it to the reference position;

with the wooden pattern or the steel plate being returned to the reference position, obtains a first straight line connecting the first and second contact points and a second straight line connecting the third and fourth contact points;

calculates the three-dimensional coordinates of a heating point on the basis of a point of intersection of the first and second straight lines;

based on an angle of intersection of the first and second straight lines, calculates a bending angle for the steel plate at the heating point; and after obtaining a heating point, or a heating point and a bending angle, relative to a certain reference point, repeats the same steps as described above while bringing the first and third contact points on a reference point side, which have been used in the determination of the heating point, into contact with each other to use their contact point as a new reference point, thereby calculating respective heating points, or respective heating points and respective bending angles, along a specific line up to the end of the steel plate; and a heating line determining unit which reads in data on the heating points and bending angles calculated by the heating point determining unit;

draws straight lines from a certain heating point on a certain line, as a starting point, to heating points on other lines on the basis of data on the respective heating points and bending angles;

examines the degree of parallelism between each of the straight lines and a roller line involved during primary bending of the steel plate;

if this degree of parallelism is within a predetermined range, and if the amounts of heating at the heating points determined by the bending angles of the steel plate at the respective heating points are equal to each other, performs grouping of the relevant heating points as the heating points of the same group; and connects the respective heating points of the same group by a straight line or a curve to determine a heating line.

43. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

determines the number of a plurality of congruent isosceles triangles, which are connected together while sharing their equal sides, on the basis of the radius of a curve of the target shape of the steel plate, the radius of a curve of the measured shape of the steel plate, and a separately set bending angle of the steel plate so that when the curve of the target shape of the steel plate is regarded as an arc, the arc of the target shape of the steel plate can be approximated by a fold line defined by the bases of the plural congruent isosceles triangles and that when the curve of the measured shape of the steel plate is regarded as an arc, the arc of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape by the number of the isosceles triangles to form respective points on the arc; and calculates the coordinates of the respective points as heating points.

44. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

divides a curve of the target shape of the steel plate into a plurality of successive segments;

similarly divides a curve of the measured shape of the steel plate into a plurality of successive segments in correspondence with the curve of the target shape;

determines the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape in each segment by the number of the isosceles triangles to form respective points on the arc; and calculates the coordinates of the respective points as heating points.

45. The automatic plate bending system using high frequency induction heating of claim 1, further comprising:

a heating point determining unit which reads in target shape data on a target shape of a steel plate to be bent, and steel plate shape measurement data to be obtained by measuring a surface shape of the steel plate;

determines the number of a plurality of congruent isosceles triangles, which are connected together while sharing their equal sides, on the basis of the radius of a curve of the target shape of the steel plate, the radius of a curve of the measured shape of the steel plate, and a separately set bending angle of the steel plate so that when the curve of the target shape of the steel plate is regarded as an arc, the arc of the target shape of the steel plate can be approximated by a fold line defined by the bases of the plural congruent isosceles triangles and that when the curve of the measured shape of the steel plate is regarded as an arc, the arc of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape by the number of the isosceles triangles to form respective points on the arc; and calculates the coordinates of the respective points as heating points; and a heating line determining unit which reads in data on the heating points calculated by the heating point determining unit;

draws straight lines from a certain heating point on a certain arc, as a starting point, to heating points on other arcs on the basis of the data on the respective heating points;

examines the degree of parallelism between each of the straight lines and a reference line that is a straight line showing the direction of a central axis of a cylinder provided that the target shape is approximately deemed as a part of the cylinder;

if this degree of parallelism is within a predetermined range, performs grouping of the relevant heating points as the heating points of the same group; and connects the respective heating points of the same group by a straight line or a curve to determine a heating line.

46. The automatic plate bending system using high frequency induction heating of claim 1, further comprising:

a heating point determining unit which reads in target shape data on a target shape of a steel plate to be bent, and steel plate shape measurement data to be obtained by measuring the surface shape of the steel plate;

divides a curve of the target shape of the steel plate into a plurality of successive segments;

similarly divides a curve of the measured shape of the steel plate into a plurality of successive segments in correspondence with the curve of the target shape;

determines the number of a plurality of congruent isosceles triangles, which are connected together while sharing their equal sides, for each segment on the basis of the radius of a division of the curve in each segment of the target shape of the steel plate, the radius of a division of the curve in each segment of the measured shape of the steel plate, and a separately set bending angle of the steel plate so that when the division of the curve in each segment of the target shape of the steel plate is regarded as an arc, the arc in each segment of the target shape of the steel plate can be approximated by a fold line defined by the bases of the plural congruent isosceles triangles and that when the division of the curve in each segment of the measured shape of the steel plate is regarded as an arc, the arc in each segment of the measured shape of the steel plate can be approximated by a fold line defined by the bases of a plurality of other congruent isosceles triangles which are connected together while sharing their equal sides, the number of the latter isosceles triangles being the same as the number of the former isosceles triangles whose bases constitute the approximating fold line for the target shape;

divides the arc of the measured shape in each segment by the number of the isosceles triangles to form respective points on the arc; and calculates the coordinates of the respective points as heating points; and a heating line determining unit which reads in data on the heating points calculated by the heating point determining unit;

draws straight lines from a certain heating point on a certain arc, as a starting point, to heating points on other arcs on the basis of the data on the respective heating points;

examines the degree of parallelism between each of the straight lines and a reference line that is a straight line showing the direction of a central axis of a cylinder provided that the target shape is approximately deemed as a part of the cylinder;

if this degree of parallelism is within a predetermined range, performs grouping of the relevant heating points as the heating points of the same group; and connects the respective heating points of the same group by a straight line or a curve to determine a heating line.

* * * * *

UNITED STATES PATENT AND TRADEMARK OFFICE
CERTIFICATE OF CORRECTION

PATENT NO. : 6,002,118

DATED : December 14, 1999

INVENTOR(S): KAWANO et al.

It is certified that error appears in the above-identified patent and that said Letters Patent is hereby corrected as shown below:

Title page, item [30] should read as following:

[30] Foreign Application Priority Data

| | | | |
|---|---|---|---|
| Sep. 24, 1997 | [JP] | Japan | 9-258200 |
| Sep. 24, 1997 | [JP] | Japan | 9-258201 |
| Sep. 24, 1997 | [JP] | Japan | 9-258202 |
| Sep. 29, 1997 | [JP] | Japan | 9-263748 |
| Sep. 29, 1997 | [JP] | Japan | 9-263751 |
| Sep. 16, 1998 | [JP] | Japan | 10-261088 |
| Sep. 16, 1998 | [JP] | Japan | 10-261089 |

Signed and Sealed this

Sixth Day of February, 2001

*Attest:*

*Attesting Officer*

Q. TODD DICKINSON

*Director of Patents and Trademarks*